US006944951B2

(12) United States Patent
Barden

(10) Patent No.: US 6,944,951 B2
(45) Date of Patent: Sep. 20, 2005

(54) APPARATUS FOR MAKING REINFORCING CAGES FOR REINFORCING CONCRETE

(76) Inventor: Wayne Barden, 100-104 Albert Street, Eagleby, Queensland 4001 (AU)

( * ) Notice: Subject to any disclaimer, the term of this patent is extended or adjusted under 35 U.S.C. 154(b) by 0 days.

(21) Appl. No.: 10/381,053

(22) PCT Filed: Sep. 26, 2001

(86) PCT No.: PCT/AU01/01208

§ 371 (c)(1),
(2), (4) Date: Jul. 2, 2003

(87) PCT Pub. No.: WO02/26417

PCT Pub. Date: Apr. 4, 2002

(65) Prior Publication Data

US 2004/0049910 A1 Mar. 18, 2004

(30) Foreign Application Priority Data

Sep. 26, 2000 (AU) ..... PR0375

(51) Int. Cl.[7] ..... B21D 49/00; B23P 19/00
(52) U.S. Cl. ..... 29/897.34; 29/791
(58) Field of Search ..... 29/700, 897.34, 29/791; 140/112; 52/167.1, 167.4

(56) References Cited

U.S. PATENT DOCUMENTS 4,150,475 A 4/1979 Bondpers et al.
5,665,254 A 9/1997 Isono et al.
6,092,341 A * 7/2000 Yamashita et al. ..... 52/167.1
6,223,785 B1 5/2001 Barden

FOREIGN PATENT DOCUMENTS

| | | |
|---|---|---|
| AU | 23214/95 A | 1/1996 |
| DE | 24 26 027 | 12/1974 |
| EP | 0 035 477 A1 | 11/1991 |
| GB | 1449144 | 9/1976 |

* cited by examiner

*Primary Examiner*—John C. Hong
(74) *Attorney, Agent, or Firm*—Hoffman, Wasson & Gitler

(57) ABSTRACT

An apparatus for making reinforcing cages, the apparatus having: a frame; a former adapted to receive a plurality of longitudinally extending reinforcing rods; a bed attached to the frame, wherein the former rests on and is able to rotate relative to the bed; a drive for rotating the former; a loading module located adjacent to the former; a shuttle mounted on the loading module for longitudinal reciprocal movement towards and away from the former, wherein the shuttle feeds reinforcing rods into the former by moving towards the former, and withdraws the reinforcing rods from the former by moving away from the former as a reinforcing band is positioned around the reinforcing bars; and a rotatable cage holder adapted to hold a reinforcing cage during construction of the reinforcing cage, the cage holder being adapted to substantially prevent twisting of the reinforcing rods which form part of the reinforcing cage.

45 Claims, 43 Drawing Sheets

APPARATUS FOR MAKING REINFORCING CAGES FOR REINFORCING CONCRETE

FIELD OF THE INVENTION

The present invention relates to an apparatus for making reinforcing cages for reinforcing concrete and concrete piles.

DESCRIPTION OF THE PRIOR ART

Reinforcing cages typically have a plurality of longitudinally extending reinforcing rods. The rods are arranged such that they form a square, circular or other configuration when viewed in transverse section. The rod arrangement is maintained by a plurality of bands which extend about the rods at locations along the length of the rods. These bands are typically circular and are fixed to the rods by welding. Sometimes a continuous spiral band is employed in place of or in addition to the individual bands.

The manufacture of such cages is particularly labour intensive and typically requires the use of a stationary jig. The longitudinally extending rods are supported by the jig which maintains the positions of the rods relative to one another. A series of bands are then placed at intervals along the length of the rods. The bands are progressively welded to the rods to complete the cage. Partial disassembly of the jig is necessary to remove the finished cage from the jig. Alternatively, a band is secured to the rods and the rods are then withdrawn slightly from the jig so that further bands can be secured to the rods.

This method of manufacturing reinforcing cages is particularly labour intensive and, as a consequence, the resultant cages are expensive to manufacture.

A further problem which is often encountered when constructing particularly long cages or cages which are constructed from relatively thin gauge rods is that such cages have a tendency to twist during their construction. This problem is particularly prevalent when using the previously mentioned manufacturing technique of withdrawing the reinforcing rods from a jig.

It is therefore an object of the present invention to overcome, or at least ameliorate, one or more of the deficiencies associated with the prior art.

SUMMARY OF THE INVENTION

According to a first aspect of the present invention there is provided an apparatus for making a reinforcing cage, the apparatus comprising a frame, a former adapted to receive a plurality of longitudinally extending reinforcing rods, a bed supported by a frame, wherein the former rest on and is able to rotate relative to the bed, a drive rotating the former, a loading module located adjacent to the former, and having a shuttle mounted for longitudinal reciprocal movement towards and away from the former, whereby the shuttle may feed reinforcing rods into the former as it moves toward the former, and may withdraw the reinforcing rods from the former as a reinforcing band is placed around the withdrawn reinforcing rods, and a rotatable cage holder adapted to hold on to the reinforcing cage and to rotate with the former while holding on to the cage such that the former is unable to rotate relative to the cage holder, whereby the cage holder is able to substantially prevent twisting of the reinforcing rods as the former rotates.

Advantageously, the frame is adapted to raise and lower the former.

Preferably, the former includes a plurality of reinforcing rod supporting members. The supporting members may include tubes. The tubes may be circumferentially spaced from one another and secured together to define a cylindrical former. The tubes may be secured together by a plurality of longitudinally spaced rings which extend about the tubes. The tubes may be secured to a cylindrical pipe. The tubes may extend past at least one end of the pipe. The supporting members may include at least one plate which is secured to the pipe, the plate having apertures extending therethrough. Tubes may extend from the apertures.

The reinforcing rod supporting members may include tubes, wherein the tubes are secured together by a plurality of longitudinally spaced rings which extend about the tubes. The locations of the tubes relative to each other may be adjustable.

The reinforcing rod supporting members may include at least one plate having apertures extending therethrough. The plate may be secured to a cylindrical pipe. Tubes may extend from the apertures.

Advantageously, the bed includes a plurality of rollers which are adapted to support the former. Preferably, at least one of the rollers is driven by the drive.

Preferably, the apparatus includes a press assembly which is adapted to bias the former onto the bed.

The loading module may include a table adjacent the shuttle onto which reinforcing rods may be positioned and presented to allow the shuttle to feed the rods to the former. The loading module may be adapted to be raised and lowered. The loading module may include longitudinally extending rails along which the shuttle may be driven for movement towards and away from the former. The loading module may include a pair of longitudinally extending support rollers arranged on opposite sides of the shuttle on which the reinforcing cage is rotatably supported as the shuttle moves away from the former. An unloading ramp may be situated on one side of the shuttle opposite the table. The support rollers may be driven by a drive. A cantilevered support may extend from one end of the loading module, wherein the cantilevered support forms an extension to the loading module. The loading module may include a drive and at least one drive chain may extend between that drive and the shuttle.

The shuttle may include an upright member having one end receivable by the rails.

Preferably, the rotatable cage holder has an axle which is coupled to the former such that the axle rotates in unison with the former. A plurality of cage engaging members may extend from the axle, wherein the cage engaging members are adapted to engage with the reinforcing cage. The rotatable cage holder may include a rotatable hub which is mounted to the shuttle, the hub being adapted to couple with the axle. The apparatus may include a drive which is adapted to be coupled to the axle and to move the axle towards the former. The drive may include a winch.

Preferably, the rotatable cage holder has an axle which is coupled to the former such that the axle rotates in unison with the former. A plurality of cage engaging members may extend from a rotatable hub which is mounted to the shuttle, wherein the cage engaging members are adapted to engage with the reinforcing cage. The hub may be detachably coupled to the axle.

Preferably, the apparatus may include a feed which is operable to direct a reinforcing bar towards the reinforcing rods such that rotation of the former causes the reinforcing bar to wrap around the rods in a spiral fashion. The feed may include guide rollers which are adapted to direct the reinforcing bar in a spiral fashion about the reinforcing rods extending from the former.

Advantageously, the apparatus may have a support assembly which is adjacent to the former, wherein the support assembly is adapted to support the reinforcing rods introduced into the former. The support assembly may be adapted to be raised and lowered. The support assembly may include support spiders consisting of frames and support discs rotatably received by the frames. The support discs may be coupled to the former such that the support discs and the former rotate in unison. The support discs may be coupled to the former by an axle. A guide may be located adjacent to one of the discs, wherein the guide is adapted to direct the rods which project through the former into supporting engagement with the disc.

Advantageously, the apparatus may have an ejection module which is operable to eject a reinforcing cage from the loading module. The ejection module may be adapted to support a reinforcing cage.

Preferably, the apparatus may have a support module which is adapted to support a reinforcing cage.

In order that the invention may be more fully understood and put into practice, preferred embodiments thereof will now be described with reference to the accompanying drawings.

DETAILED DESCRIPTION

Figure 1:
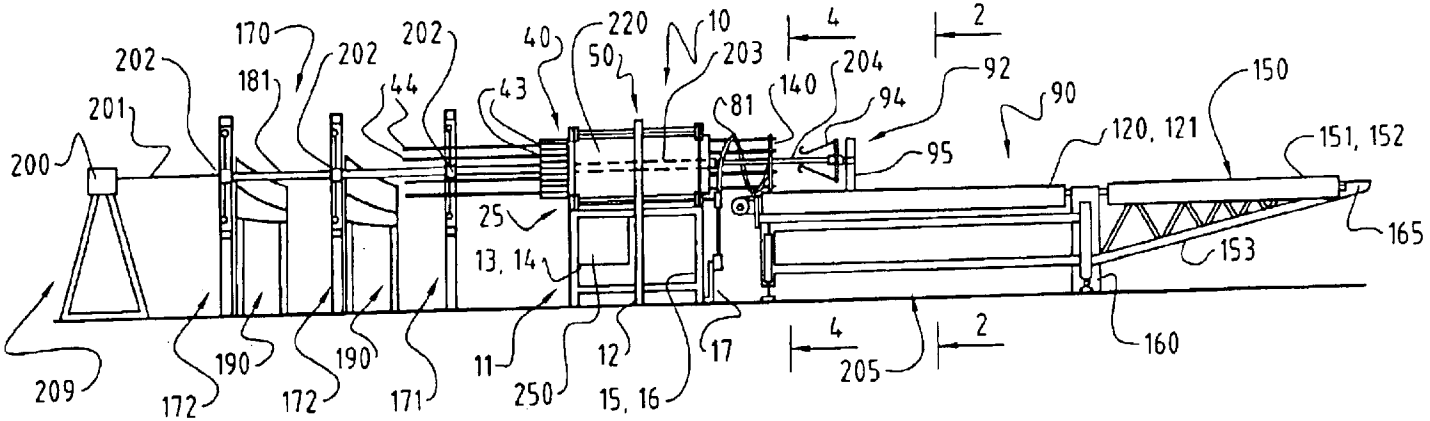
FIG. 1 is a front elevation of an apparatus for making reinforcing cages according to a first embodiment of the invention.

A first embodiment of an apparatus for making reinforcing cages is illustrated in FIG. 1. The apparatus, which is designated generally by the numeral 10, has a frame 11. The frame 11 includes upright frame members 12 to 17. The frame members 12 to 17 terminate in ground engaging legs. Cross frame members 18 to 22 (see FIG. 4) extend between various ones of the upright frame members 12 to 17.

The apparatus 10 includes a bed 25. The bed 25 includes rollers 26 to 29 (see FIGS. 3 and 4). A shaft 34 extends between rollers 26 and 28. A shaft 35 extends between rollers 27 and 29. A first drive 250 having a motor and a gearbox is operable to rotate the rollers 26 to 29.

Figure 3:
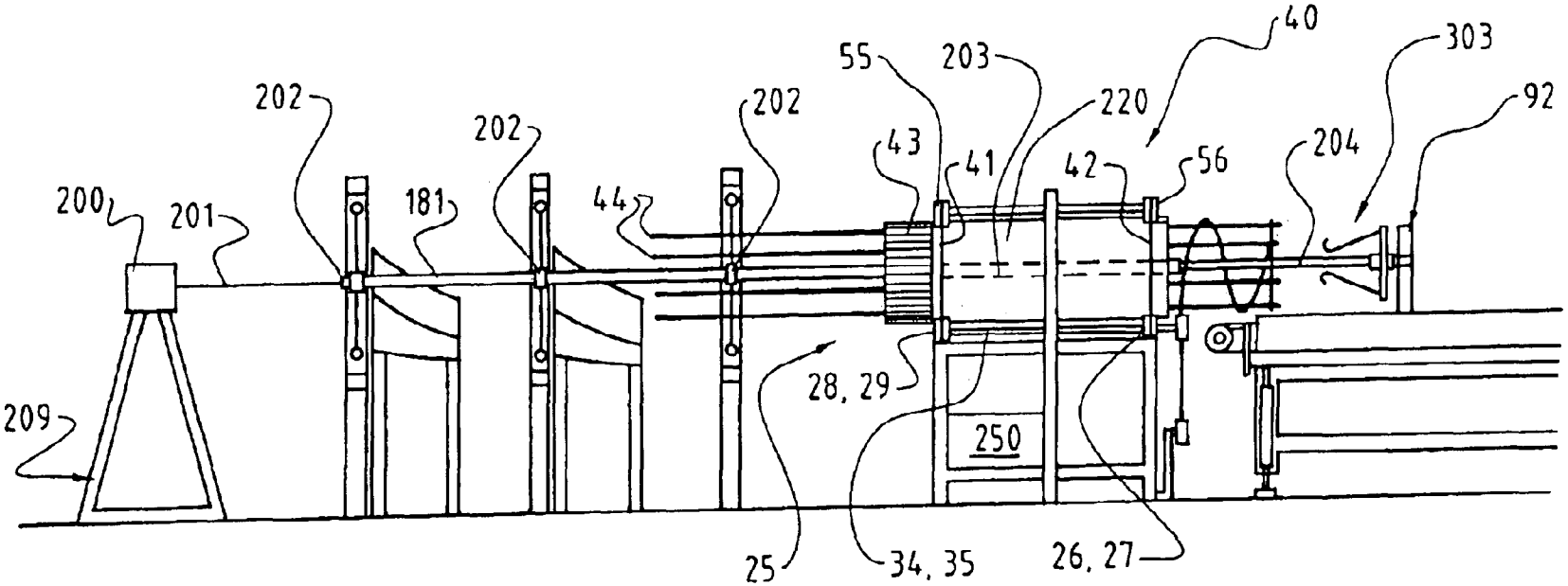
FIG. 3 is a front elevation of a portion of the apparatus illustrated in FIG. 1.

With reference to FIG. 3 a former 40 rests on the bed 25. The former 40 includes a plurality of tubes 43 which are circumferentially spaced from one another and secured to a first cylindrical pipe 220. The tubes 43 protrude from one end of the first pipe 220 and are adapted to receive longitudinally extending reinforcing rods 44. The former 40 has rings, 41, 42 which extend around the first pipe 220. The rings 41, 42 rest upon the rollers 26 to 29. Rotation of the rollers 26 to 29 causes the former 40 to rotate.

Figure 4:
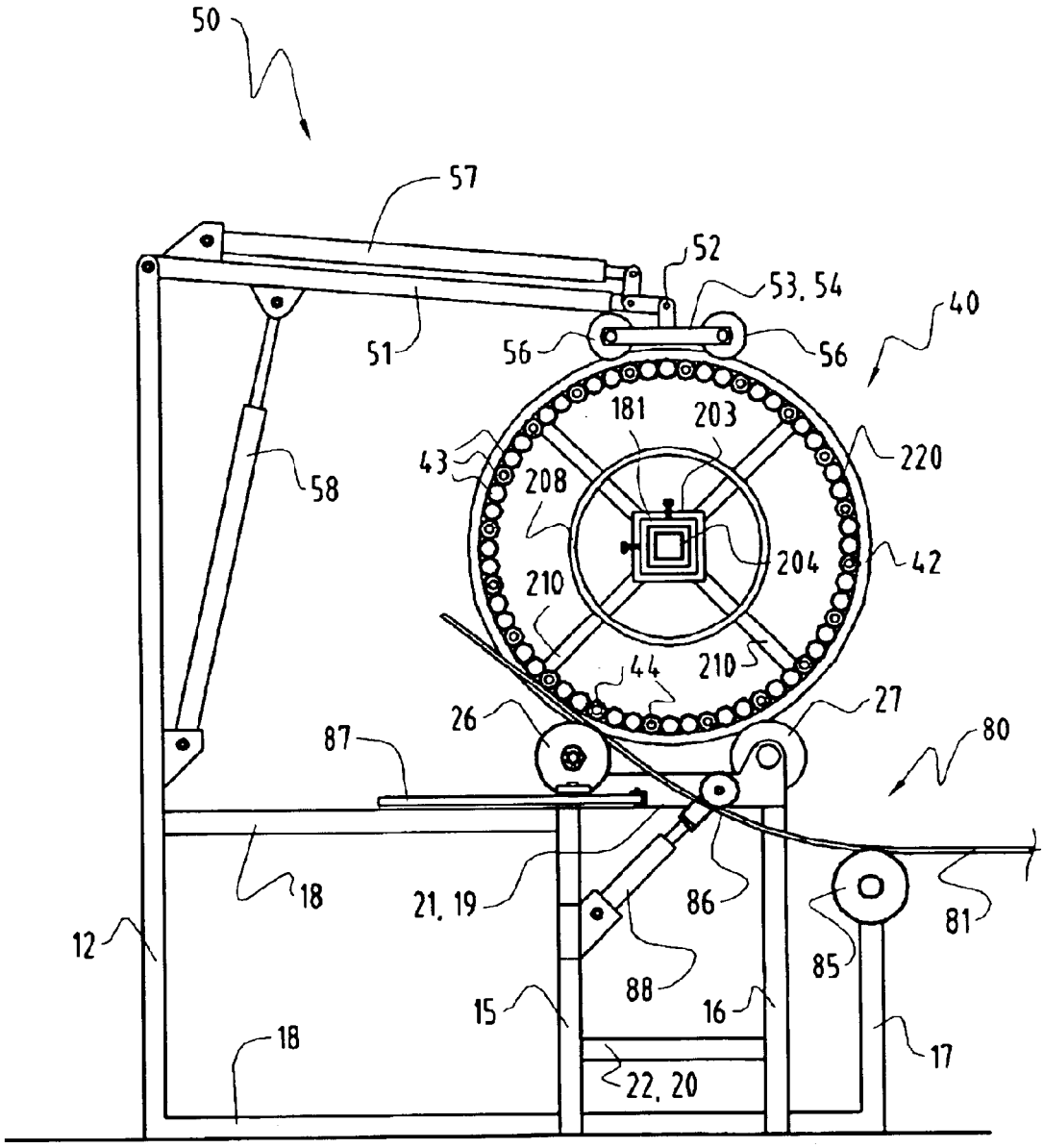
FIG. 4 is a section view of the apparatus illustrated in FIG. 1 taken along the line 4—4.

Referring to FIG. 4, webs 210 are attached to the interior of the first pipe 220 and extend the length of the first pipe 220. The webs 210 support a second cylindrical pipe 208 which is concentric with the first pipe 220. The second pipe 208 extends the length of the first pipe 220. The webs 210 also support a hollow first axle 203 having a square cross-section. The first axle 203 extends the length of the first pipe 220. The first axle 203 receives a hollow second axle 181. The second axle 181 receives a hollow third axle 204 which is slidable with respect to the second axle 181. The second and third axles 181, 204 each have a square cross-section and are dimensioned so that there is minimal or no rotational slippage between the first axle 203, second axle 181 and third axle 204. By configuring the axles 181, 204 and 203 in this way, various components of the apparatus 10, which will be described later, are able to rotate in unison with each other so as to prevent twisting of the reinforcing rods 44 during the construction of a reinforcing cage.

Figure 5:
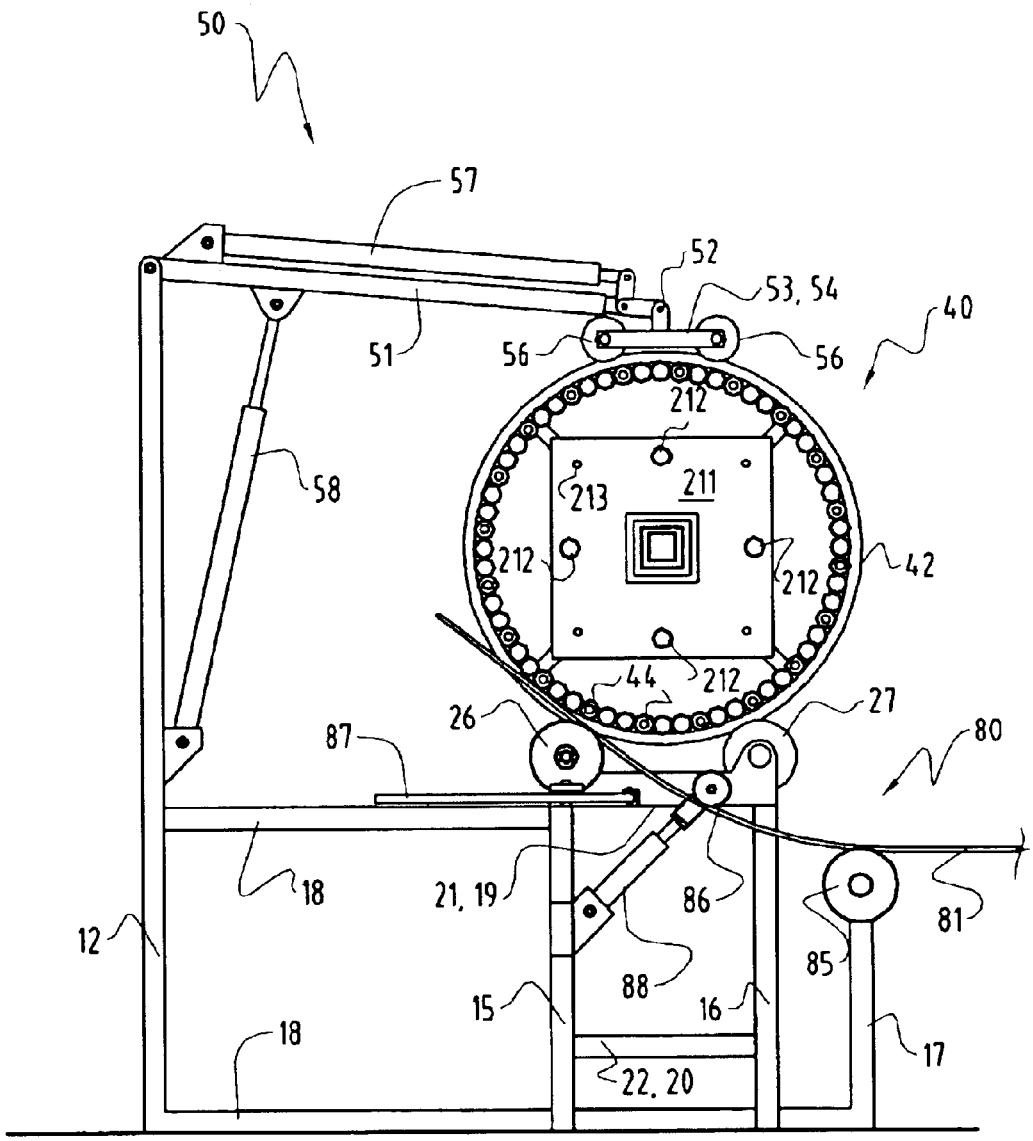
FIG. 5 is similar to FIG. 4, however the former has been modified to include support plates.

FIG. 5 is similar to FIG. 4 except that plates 211 have been secured to both ends of the former 40. The plates 211 are secured to the former 40 by attachment means 213 such as bolts. Four apertures 212 extend through each plate 211. The apertures 212 are arranged such that they form the comers of a square.

Figure 6:
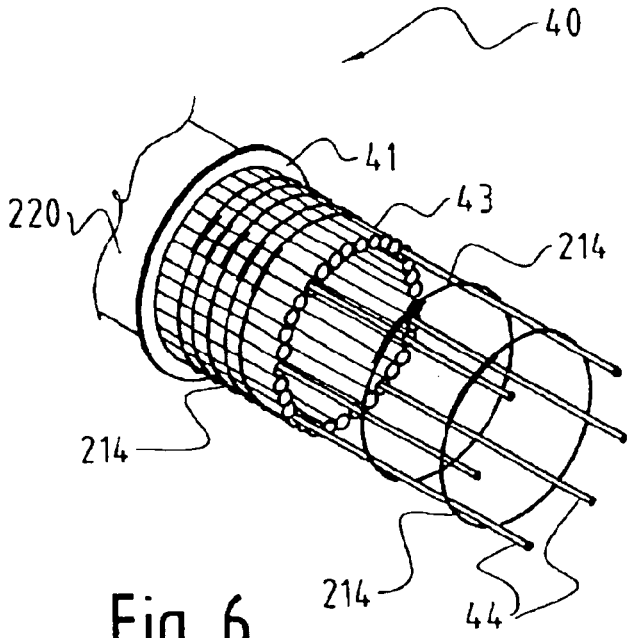
FIG. 6 is a partial perspective view of the former which forms part of the apparatus illustrated in FIG. 1.

FIG. 6 is a partial perspective view of the former 40 which forms part of the apparatus 10 illustrated in FIGS. 1, 3 and 4. The tubes 43 protrude beyond an end of the first pipe 220. Reinforcing rods 44 are shown extending through a number of the tubes 43. When the reinforcing rods 44 are viewed end-on, the reinforcing rods 44 have a substantially circular configuration. A plurality of prefabricated reinforcing bands 214 are stored on the former 40 by placing the bands 214 around the tubes 43 which protrude from the first pipe 220. The use of this storage feature in the construction of reinforcing cages will now be described. The former 40 is firstly placed upon the bed 25 of the apparatus 10 so that the protruding tubes 43 are adjacent to the loading module 90. The prefabricated reinforcing bands 214 are then placed over the protruding tubes 43 in the manner previously described. Reinforcing rods 44 are then inserted into the former 40 so that the rods 44 extend from the protruding tubes 43. A first prefabricated reinforcing band 214 which is closest to the end of the protruding tubes 43 is then slid along the tubes 43 and onto the reinforcing rods 44. The first band 214 is then welded to the reinforcing rods 44. As the reinforcing rods 44 are progressively withdrawn from the former 40, further reinforcing bands 214 are slid from the tubes 43 and onto the reinforcing rods 44. Those reinforcing bands 214 are also welded to the reinforcing rods 44.

Figure 7:
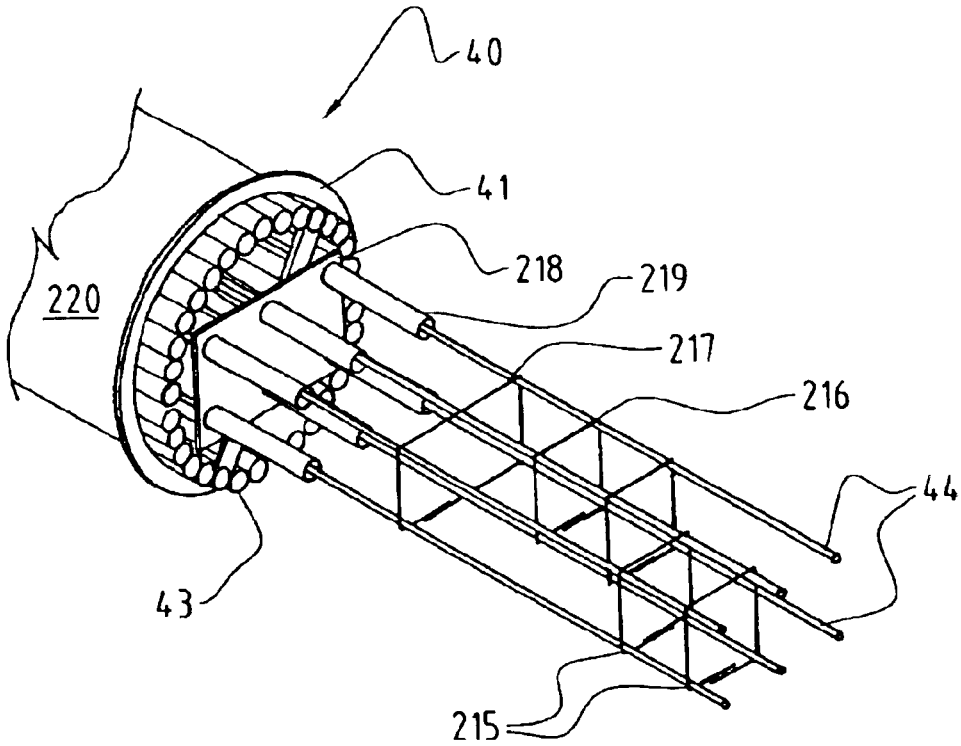
FIG. 7 is a partial perspective view of a variation of the former which forms part of the apparatus illustrated in FIG. 1.

The former 40 illustrated in FIG. 7 is similar to the former 40 illustrated in FIG. 6 except that the tubes 43 of the former 40 illustrated in FIG. 7 do not protrude quite as much from the first pipe 220. Further, a plate 218 is secured to an end of the former 40. The plate 218 has six apertures which are configured to receive reinforcing rods 44. The apertures are arranged into a rectangular configuration so that the reinforcing cages produced by using the former 40 will have a substantially rectangular configuration when viewed end-on. Support tubes 219 extend from the apertures. Reinforcing bands 215 to 217 are stored on the former 40 by placing the bands 215 to 217 around the tubes 219. As the reinforcing rods 44 are progressively withdrawn from the former 40 the bands 215 to 217 are sequentially slid from the tubes 219 onto the reinforcing rods 44 and are welded to the rods 44. It is not necessary for all of the bands 215 to 217 to extend around each reinforcing rod 44.

Referring to FIG. 4, the apparatus 10 includes an adjustable press assembly 50. The press assembly 50 includes a telescopic arm 51 pivotally coupled to the upright 12. The arm 51 telescopically receives a member 52 which extends lengthwise along the former 40. A telescopic support arm 57 is coupled to the arm 51 and the member 52. Cross members 53, 54 extend from either end of the member 52. The cross members 53, 54 carry press wheels 55, 56. The press wheels 55, 56 engage with the rings 41, 42 which extend around the former 40. A cylinder assembly 58, which extends between arm 51 and upright 12, biases the press wheels 55, 56 against the rings 41, 42. Biasing the press wheels 55, 56 in this manner maintains the former 40 in contact with the bed 25.

The telescopic possibility of arms 51 and 57 enables the press assembly 50 to accommodate formers 40 of different diameters.

As shown in FIG. 4 the apparatus 10 includes a feed 80 which is operable to direct a reinforcing band 81 towards the rods 44 such that rotating the former 40 while withdrawing the rods 44 from the former 40 causes the reinforcing band 81 to wrap around the rods 44 in a spiral fashion. As the reinforcing band 81 is wrapped around the rods 44, the band 81 can be welded to the rods 44. The feed 80 includes a guide roller 85 supported by upright 17, a guide roller 86 and a lever 87 for directing the band 81 against the rods 44. Roller 86 is adjustably mounted relative to a cylinder assembly 88. By extending or retracting the cylinder assembly 88 the position of roller 86 may be altered.

Figure 2:
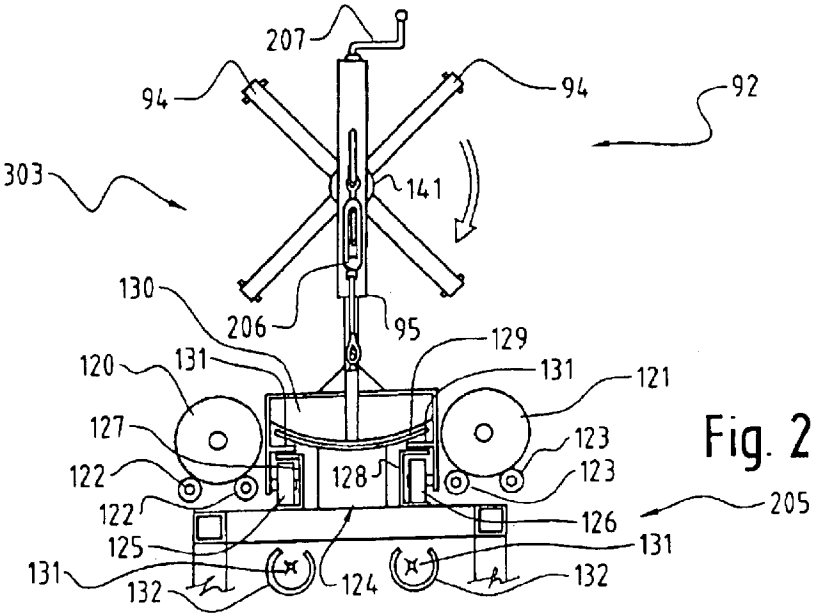
FIG. 2 is a section view of the apparatus illustrated in FIG. 1 taken along the line 2—2.

Referring to FIGS. 1 and 2, the apparatus 10 includes a loading module 90. The loading module 90 includes a support frame 205 which is formed from a plurality of upright members and a plurality of cross members which extend between various ones of the upright members.

Parallel support rollers 120, 121 extend the length of the loading module 90. The support rollers 120, 121 are configured to receive and support a reinforcing cage such that the reinforcing cage is able to rotate relative to the support rollers 120, 121. The support rollers 120, 121 rest on rollers 122, 123. Rotation of rollers 122, 123 causes the support rollers 120, 121 to rotate and vice versa.

Parallel rails 127, 128 extend the length of the loading module 90. The parallel rails 127, 128 are secured to the support frame 205.

A support member 124 extends the length of the support module 90. The support member 124 is secured to the support frame 205.

A guide rail 129 having a curved upper surface extends the length of the support module 90. The guide rail 129 is secured to the support member 124. The guide rail 129 functions to receive reinforcing rods 44 so that the rods 44 can be slid along the rail 129 and inserted into the former 40.

A cantilevered support 150 forms an extension to the loading module 90. The cantilevered support 150 includes a frame 153. Support rollers 151, 152 are mounted to the frame 153. The rollers 151, 152 function as extensions of the rollers 120, 121. The rails 127, 128, support member 124 and guide rail 129 extend along the length of the cantilevered support 150.

A drive, which is located within a housing 160, is operable to rotate rollers 120, 121, 151 and 152.

The module 90 also includes a table (not shown) which is adjacent to a longitudinal side of the module 90. The table functions as a place where reinforcing rods like those identified by the numeral 44 may rest before they are placed on the guide rail 129 for insertion into the former 40.

An unloading ramp (not shown) is located on the opposite side of the loading module 90 to the table. The ramp assists in the removal of completed reinforcing cages from the apparatus 10.

The apparatus 10 also has a shuttle 92. Referring to FIG. 2, the shuttle 92 includes an upright 95 and opposed rollers 125, 126 which are coupled to one end of the upright 95. The rollers 125, 126 are received within the longitudinally extending rails 127, 128 of the loading module 90. The rollers 125, 126 enable the shuttle 92 to be moved along the length of the loading module 90 including the cantilevered support 150.

A buffer member 130 is attached to one end of the upright 95. A lower edge of the buffer member 130 is configured to closely follow and complement the curve of the guide rail 129. This configuration enables the buffer member 130 to abut against the end of a reinforcing rod 44 which may rest upon the guide rail 129. Movement of the shuttle 92 towards the former 40 combined with the buffer member 130 abutting against the end of the rod 44 results in the rod 44 being slid along the guide rail 129 towards the former 40.

Figure 9:
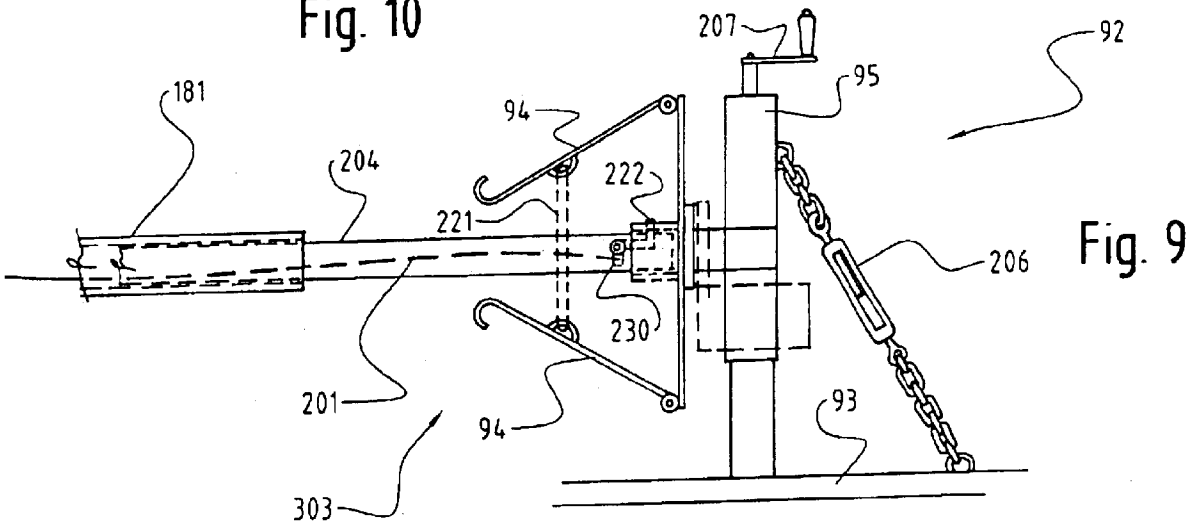
FIG. 9 is a front elevation of the shuttle which forms part of the apparatus illustrated in FIG. 1.
Figure 11:
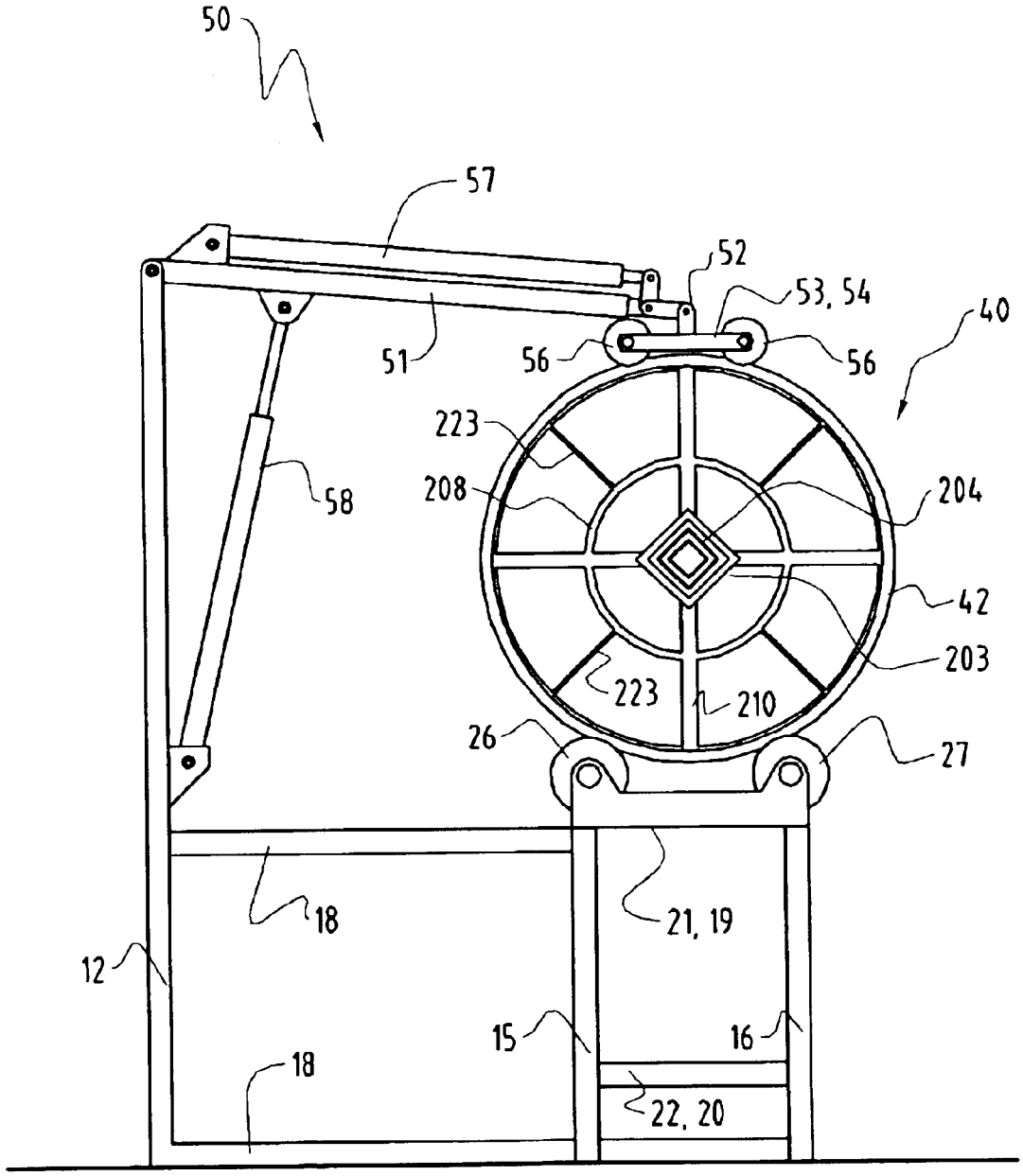
FIG. 11 is a section view of the apparatus illustrated in FIG. 10 taken along the line 11—11.
Figure 12:
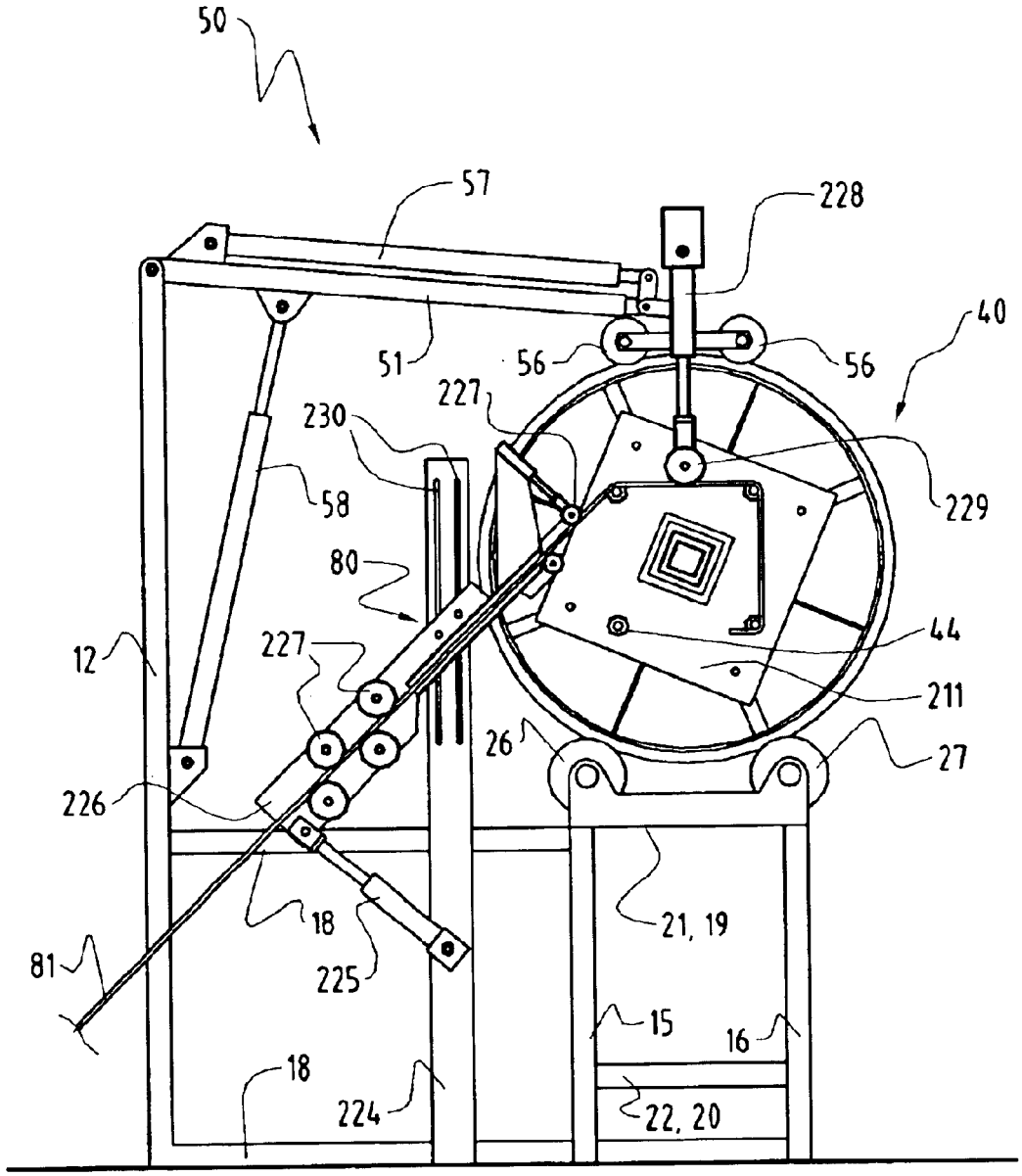
FIG. 12 is a section view of the apparatus illustrated in FIG. 10 taken along the line 12—12.
Figure 13:
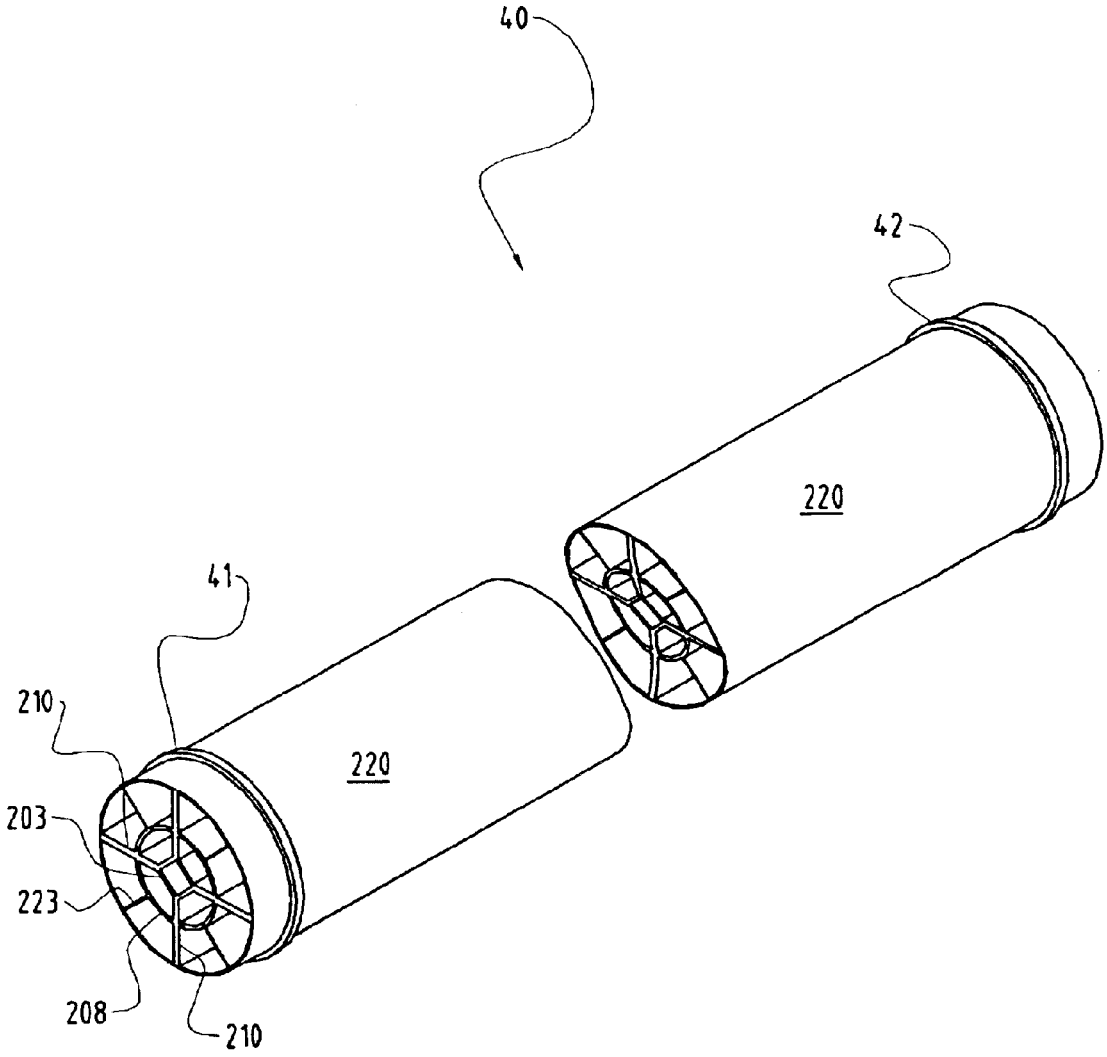
FIG. 13 is a perspective view of the former which forms part of the apparatus illustrated in FIG. 10.

The upright 95 is supported by an adjustable brace member 206 which counteracts the load placed upon the upright 95 by a reinforcing cage. FIG. 9 provides further detail of the shuttle 92. The brace member 206 is in the form of a chain having a linkage which enables the length of the chain to be adjusted.

The height of upright 95 may be adjusted by a mechanism which is operated by a rotating handle 207. This height adjustability allows the shuttle 92 to accommodate reinforcing cages of different diameters.

Chains or cables 131 are attached to the shuttle 92. The chains or cables 131 form continuous loops and a lower part of each loop is received within a respective guard 132. The guards 132 extend along and are secured to the loading module 90. Each chain or cable 131 extends around corresponding sprockets or pulleys which are mounted to the end of the loading module 90 which is closest to the former 40 and the end of the cantilevered support 150 which is furthest from the former 40. The sprockets or pulleys which are mounted to the cantilevered support 150 are rotated by a drive 165 (see FIG. 1). Rotation of the sprockets or pulleys by the drive 165 causes the chain or cable 131 to move around the sprockets or pulleys which results in the shuttle 92 moving along the loading module 90. The direction in which the sprockets or pulleys are rotated determines whether the shuttle 92 is moved towards or away from the former 40.

Reinforcing rods 44 are inserted into the former 40 by firstly operating the drive 165 to move the shuttle 92 away from the former 40 so that there is sufficient room on the guide rail 129 to accommodate a rod 44 between the shuttle 92 and the former 40. The rods 44 are placed onto the table which is adjacent to the loading module 90. One of the rods 44 is then rolled from the table onto the loading module 90 such that the rod 44 rests on the guide rail 129 between the shuttle 92 and the former 40. The former 40 is rotated so that the tube 43 or aperture of the former 40 which is to receive the rod 44 is aligned with the rod 44. The drive 165 is then operated so that the shuttle 92 moves towards the former 40. This movement causes the buffer member 130 to abut against an end of the rod 44 which is resting on the guide rail 129. The drive 165 continues to move the shuttle 92 towards the former 40 until the rod 44 has been inserted into the former 40 by the desired amount. The process is repeated for each rod 44.

Referring to FIGS. 2 and 9, the apparatus 10 also has a rotatable cage holder 303. The rotatable cage holder 303 includes a rotatable hub 141 which is mounted to the upright 95 of the shuttle 92 such that the hub 141 faces the former 40. A plurality of cage engaging members extend from and are pivotally mounted to the hub 141. The cage engaging members, which are in the form of hooked members 94, are configured to engage with a reinforcing cage such that the cage is securely held by the cage engaging members. An elastic member 221 extends between the cage engaging members and biases the cage engaging members towards each other. The hub 141 is detachably coupled to the third axle 204 with an attachment member 222. When the third axle 204 and the hub 141 are coupled together, rotation of the third axle 204 causes the hub 141 to rotate in unison with the third axle 204. Further, since there is minimal or no rotational slippage between the first axle 203, second axle 181 and third axle 204, the hub 141 will rotate in unison with the former 40. If the cage engaging members are engaged with a reinforcing cage and the third axle 204 and the hub 141 are coupled together, the reinforcing cage will rotate in unison with the former 40. This prevents twisting of the reinforcing rods 44, which form part of the reinforcing cage, as the former 40 rotates.

Referring to FIG. 1, a support assembly 170 is adjacent to an end of the former 40. The support assembly 170 is adapted to support the reinforcing rods 44 which extend from the former 40.

Figure 8:
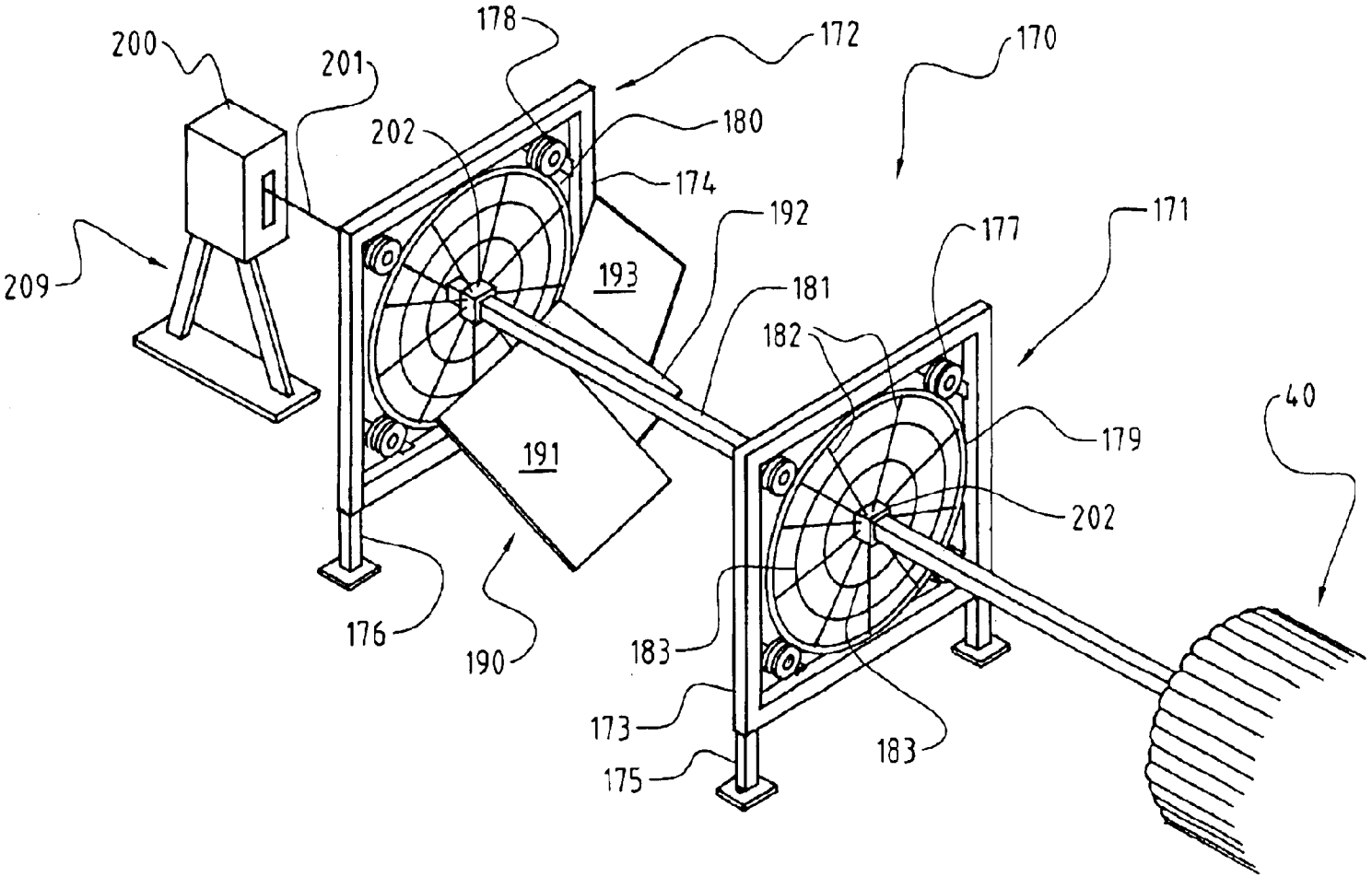
FIG. 8 is a perspective view of a reinforcing rod support assembly which forms part of the apparatus illustrated in FIG. 1.

Referring to FIG. 8, the support assembly 170 includes support spiders 171, 172 (there are actually three support spiders 172 shown in FIG. 1, however for simplicity only two are illustrated in FIG. 8). Each support spider 171, 172 includes a frame 173, 174 having height adjustable legs 175, 176. The frames 173, 174 carry rollers 177, 178 which rotatably receive support discs 179, 180.

The support discs 179, 180 include hollow axles 202 which have a square cross-section. Radial support members 182 extend from each axle 202 and concentric support rings 183 are fixed to the radial support members 182. The second axle 181 extends through and is secured to the axles 202 such that axles 181 and 202 are able to rotate in unison with each other. Since the first axle 181 rotates in unison with the former 40, the support discs 179, 180 also rotate in unison with the former 40.

A guide 190 is located adjacent to the support disc 180. The guide 190 includes plates 191, 192 and 193 which are secured to the support spider 172. The guide 190 is adapted to contact the rods 44 as they are fed into the former 40. The guide 190 directs the rods 44 into supporting engagement with the support disc 180.

Referring to FIGS. 1, 8 and 9, the apparatus 10 includes a drive in the form of a winch 200. The winch 200 is adjacent to the support assembly 170 and is mounted on a frame 209. A cable 201 from the winch 200 extends through the axles 181, 203 and 204. An end of the cable 201 is fixed to the third axle 204. The winch 200 is operable to pull the third axle 204 towards the former 40 if the third axle 204 has been decoupled from the hub 141. This is normally done when removing a completed reinforcing cage from the apparatus 10.

To construct a cage using the apparatus 10, the third axle 204 is coupled to the hub 141 with the aid of the attachment member 222. The drive 165 is then operated to move the shuttle 92 away from the former 40 so that there is sufficient room on the guide rail 129 to accommodate a rod 44 between the shuttle 92 and the former 40. Typically, the shuttle 92 is moved to the end of the loading module 90 which is furthest from the former 40. Reinforcing rods 44 are placed on the table that is adjacent to the loading module 90 and are allowed to progress one by one onto the rail 129 until one locates forwardly of the upright 95. The shuttle 92 is then driven towards the former 40 to ensure that the rod 44 is received within a selected one of the tubes 43 or apertures of the former 40. The shuttle 92 is then returned to the previous position and the former 40 is rotated through a predetermined arc. A further rod 44 is then allowed to rest in front of upright 95 and the shuttle 92 is moved towards the former 40 to cause the rod 44 to locate inside a selected tube 43 or aperture of the former 40. This process is continued until the rods 44 have been inserted into the desired tubes 43 and apertures of the former 40.

Once the rods 44 have been loaded into the former 40, a reinforcing band 140 is welded to the rods 44. The former 40 may be rotated in a stepwise fashion to allow this to be done. The shuttle 92 is then moved towards the former 40 to allow the hooked members 94 to engage with the band 140. The shuttle 92 may then be moved progressively away from the former 40 to draw the rods 44 from the tubes 43 or apertures of the former 40. As the rods 44 are withdrawn the former 40 is rotated and the reinforcing band 81 is wound in a spiral fashion around the rods 44. The band 81 is welded onto the rods 44 as the rods 44 are withdrawn and in this way a reinforcing cage is produced.

Once the cage is finished the hooked members 94 are released from the ring 140 and the third axle 204 is detached from the hub 141. The winch 200 is then operated to move the third axle 204 towards the former 40. The shuttle 92 is then moved to the end of the loading module 90 which is furthest from the former 40 so that the shuttle 92 does not obstruct the removal of the completed cage from the apparatus 10. The completed cage is then caused to travel down the ramp which is adjacent to the loading module 90 and the process may then be recommenced to produce another cage.

As an alternative to the above method of operation, the third axle 204 may be coupled to the hub 141 after the reinforcing rods 44 have been inserted into the former 40.

If a former 40 including the previously described reinforcing rod storage feature is used, the operation of the apparatus 10 is substantially the same as described above except for a few minor differences. Firstly, the former 40 is oriented so that the tubes of the former 40 which provide the storage feature are adjacent to the loading module 90. The reinforcing bands are then placed over the protruding tubes of the former 40 either before or after the reinforcing rods 44 have been loaded into the former 40.

The remaining operation is substantially the same as was previously described. However, as the reinforcing rods 44 are progressively withdrawn from the former 40, the reinforcing bands are sequentially slid from the tubes of the former 40 and onto the rods 44. The reinforcing bands are then welded to the rods 44.

It should be appreciated that the reinforcing bands may also be stored inwardly of the reinforcing rods 44. This would require the former 40 to provide supports for the reinforcing bands which are located inwardly of the tubes 43 or apertures through which the reinforcing rods 44 extend.

The apparatus 10 may be used to produce cages having various transverse profiles. For example, the apparatus 10 may be used to produce cages having square, circular or triangular transverse profiles.

Figure 10:
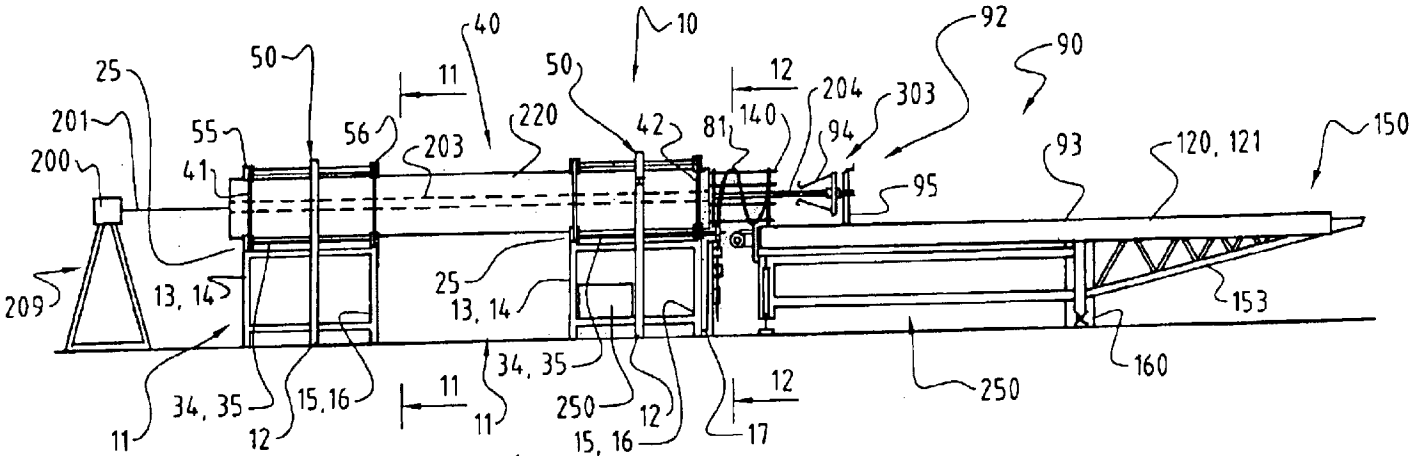
FIG. 10 is a front elevation of an apparatus for making reinforcing cages for concrete piles according to a second embodiment of the invention.

A second embodiment of an apparatus 10 for making reinforcing cages is illustrated in FIG. 10. The apparatus 10 is configured for making reinforcing cages for concrete piles. For convenience, features of the second embodiment of the apparatus 10 that are similar or correspond to features of the first embodiment of the apparatus 10 have been referenced using the same reference numbers.

The second embodiment of the apparatus 10 is similar to the first embodiment of the apparatus 10 which was described previously with reference to FIGS. 1 to 9. However, the second embodiment of the apparatus 10 has a longer former 40, two frames 11 upon which the longer former 40 rests, a modified loading module 90 and cantilevered support 150, and a modified feeder 80. Additionally, the apparatus 10 of FIG. 10 does not have a support assembly 170 as the longer former 40 is able to support the entire length of the reinforcing rods 44. As a consequence of there being no support assembly 170, the second axle 181 is not present.

Referring to FIGS. 10 to 13, the former 40 includes a first cylindrical pipe 220 and rings 41, 42 which extend around the first pipe 220. Rings 41, 42 provide a guide means for the press wheels 55, 56 of the press assembly 50 so that the former 40 maintains the same longitudinal position relative to the frames 11.

Webs 210 are attached to the interior of the first pipe 220 and extend the length of the first pipe 220. The webs 210 support a second cylindrical pipe 208 which is concentric with the first pipe 220. The second pipe 208 extends the length of the first pipe 220. The webs 210 also support a hollow first axle 203. The first axle 203 extends the length of the first pipe 220. Minor webs 223 extend between the first pipe 220 and the second pipe 208. The minor webs 223 extend the full length of the cylinder 220. The first axle 203 receives a hollow third axle 204 which is slidable with respect to the first axle 203. The first and third axles 203, 204 each have a square cross-section and are dimensioned so that there is minimal or no rotational slippage between the first axle 203 and the third axle 204.

A plate 211 is secured to the end of the former 40 which is closest to the loading module 90. The plate 211 is secured to the former 40 using bolts or other suitable attachment means. A plurality of apertures extend through the plate 211. The apertures are arranged such that they form the comers of a square.

The former 40 could also be configured to provide a reinforcing band storage feature in a similar manner to the formers 40 described in connection with the first embodiment of the apparatus 10.

Both of the frames 11 of the second embodiment of the apparatus 10 are the same as the frame 11 which was described in connection with the first embodiment of the apparatus 10.

A feeder 80 is mounted to the frame 11 which is closest to the loading module 90. The feeder 80 includes a frame member 226 which is attached to an upright frame member 224 and a cylinder assembly 225. Guide rollers 227 are attached to the frame member 226 in the manner shown. The position of the frame member 226 relative to the upright member 224 may be adjusted by means of rails 230 on the upright 224. A further guide wheel 229 is carried by a cylinder assembly 228 which is attached to the press assembly 50. The feeder 80 can be located on either side of the former 40 so as to feed the reinforcing band 81 in different directions about the reinforcing rods 44.

Referring to FIG. 10, the loading module 90 and cantilevered support 150 have been modified so that support rollers 120, 121 are continuous and extend along the loading module 90 and the cantilevered support 150.

The operation of the second embodiment of the apparatus 10 illustrated in FIG. 10 is substantially the same as that of the first embodiment of the apparatus 10.

Figure 14:
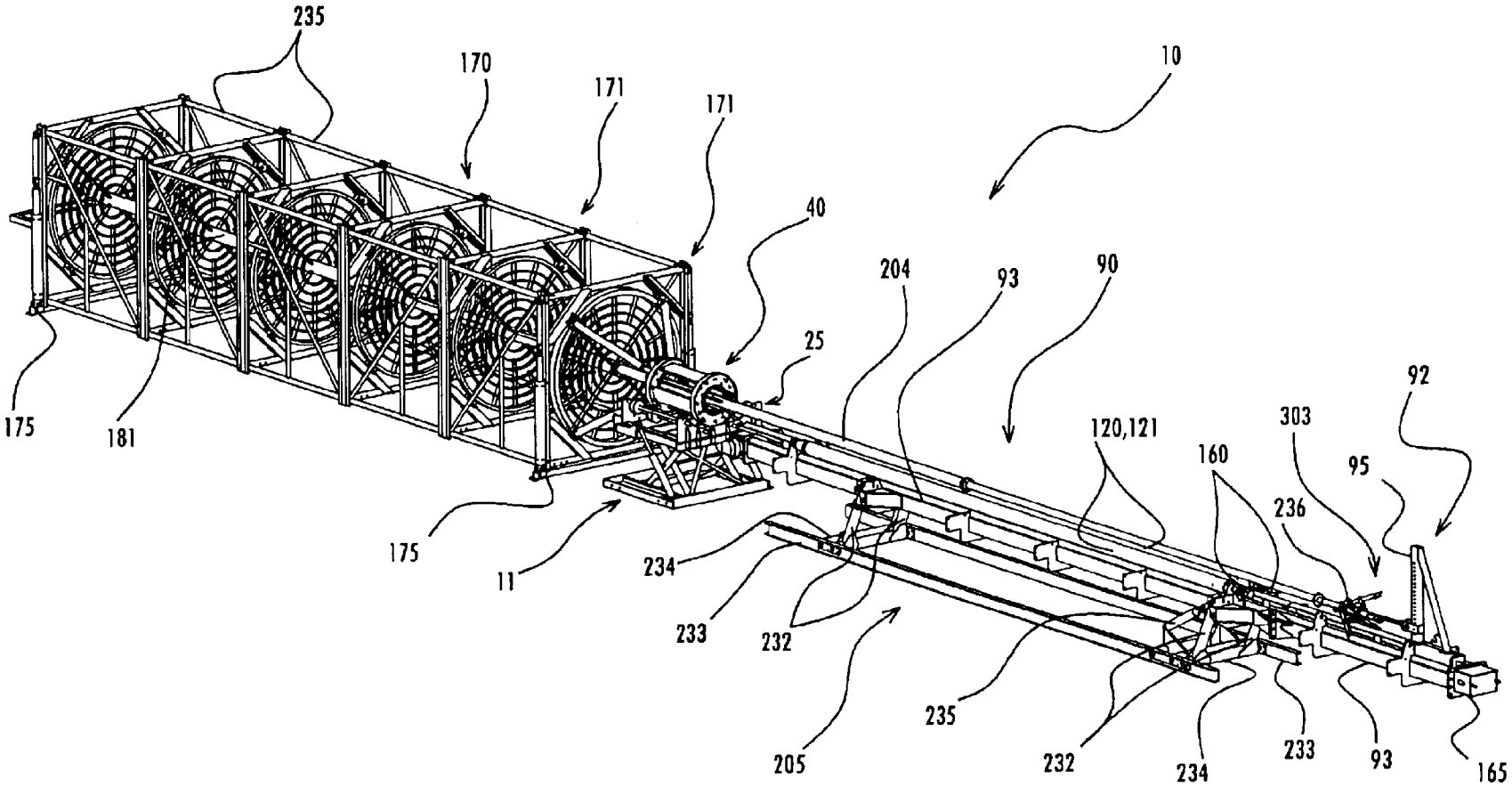
FIG. 14 is a perspective view of an apparatus for making reinforcing cages according to a third embodiment of the invention.

A third embodiment of the cage making apparatus 10 is illustrated in FIG. 14. For convenience, features of the third embodiment of the apparatus 10 that are similar or correspond to features of the previously described embodiments of the apparatus 10 have been referenced using the same reference numbers. The apparatus 10 includes a frame 11, former 40, bed 25 drive means (not shown) for rotating the former 40, loading module 90, shuttle 92, a rotatable cage holder 303 and a support assembly 170.

The loading module 90 includes a support frame 205 which is formed form a plurality of frame members 232 to 234. Frame members 232 are pivotally attached to a lower portion of the support frame 205 which is formed from frame members 233 and 234. Frame members 232 are also pivotally attached to a shuttle support 93. Adjustable rams 235 interconnect the shuttle support 93 to the lower portion of the support frame 205. This arrangement allows the shuttle support 93 to be selectively raised, lowered and tilted.

The loading module 90 also has longitudinally extending support rollers 120, 121 which function to receive and support a reinforcing cage. Drives 160 are operable to rotate the rollers 120, 121.

A shuttle 92 is mounted for reciprocal movement along the shuttle support 93. The shuttle 92 includes an upright 95 which is received by a track on the shuttle support 93. Although not shown in FIG. 14, the shuttle 92 has chains or cables attached to it. The chains or cables form continuous loops and extend substantially the full length of the shuttle support 93. A drive 165 is coupled to the chains or cables and is operable to drive the shuttle 92 back and forth along the shuttle support 93.

Frame 11 supports the bed 25 on which the former 40 rests. The configuration of the bed 25 is such that the former 40 is able to rotate relative to the bed 25. The former 40 can be raised and lowered by the frame 11.

The support assembly 170 is substantially the same as the support assembly which was described in connection with the first embodiment of the apparatus 10. The only significant difference between the support assembly 170 shown in FIG. 14 and the previously described support assembly 170 is that the spiders 171 are interconnected by frame members 302. Also, the rotatable support discs (not specifically indicated) which form part of the spiders 171 are mounted on a hollow second axle 181. The second axle 181 extends the full length of the support assembly 170. The height adjustable legs 175, which are typically drive by rams (not shown), enable the height of the support assembly 170 to be varied.

The rotatable cage holder 303 includes a hollow third axle 204 and a cage clamp 236 which is attached to one end of the third axle 204. The third axle 204 is received by the second axle 181 in such a way that the axles 204 and 181 are rotationally locked together. The third axle 204 can be retracted into the second axle 181 such that the cage clamp 236 is substantially retracted into the former 40. The third axle 204 is retracted into the second axle 181 by operating a winch (not shown) to retract a cable (not shown). The cable extends through the axles 181, 204 and is attached to the cage clamp 236. The winch (not shown) is located at an opposite end of the support assembly 170 to the former 40.

Figure 15:
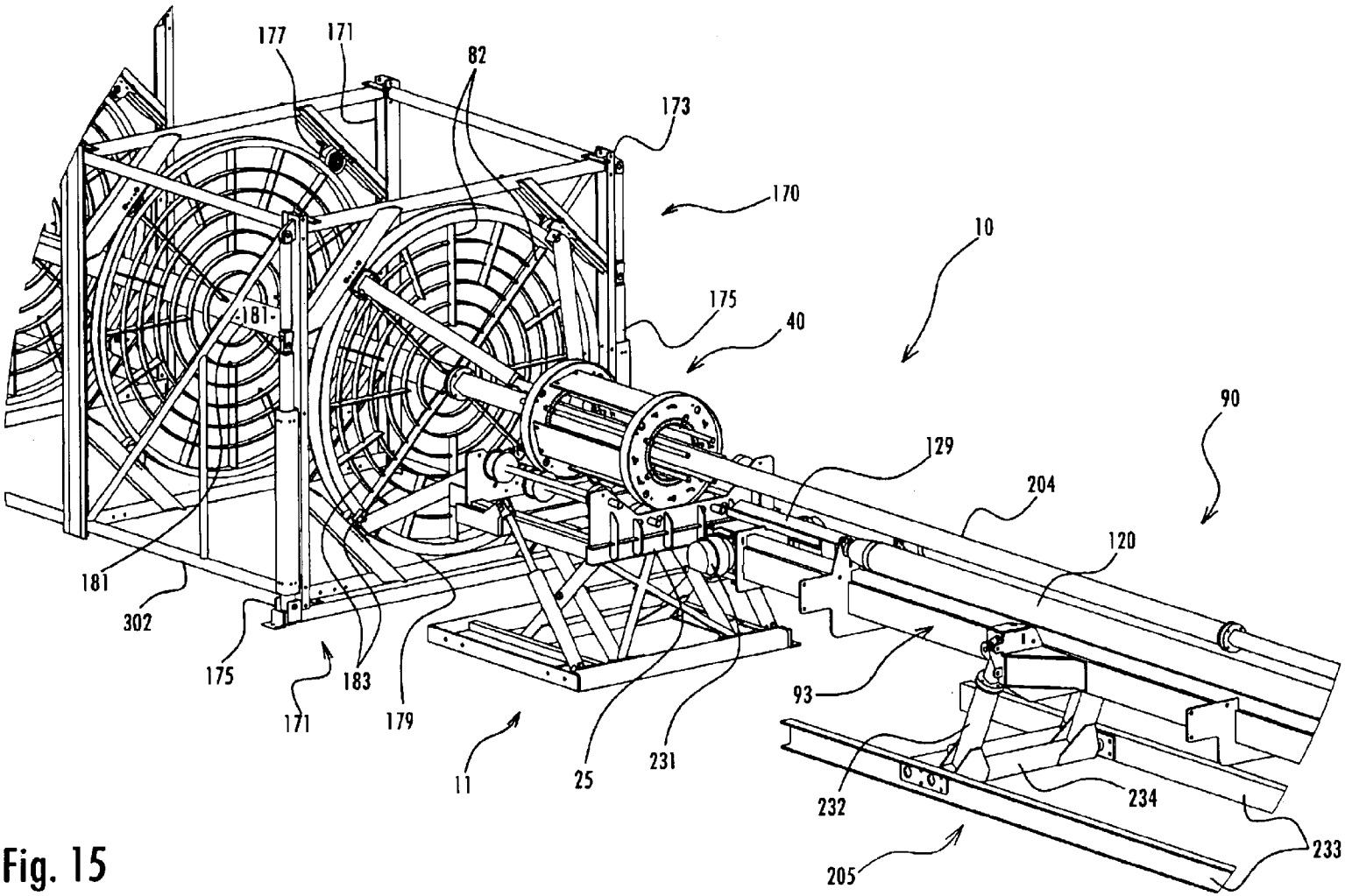
FIG. 15 is a perspective view of a portion of the apparatus illustrated in FIG. 14.

Referring to FIG. 15, the chains or cables referred to earlier in connection with the loading module 90 engage with a sprocket or pulley 231.

Also visible in FIG. 15 is a longitudinally extending guide rail 129 which extends the full length of the loading module 90. The guide rail 129 serves to guide the loading of reinforcing rods into the former 40 by the shuttle 92 in a manner similar to that described in connection with the first embodiment of the apparatus 10.

Figure 16:
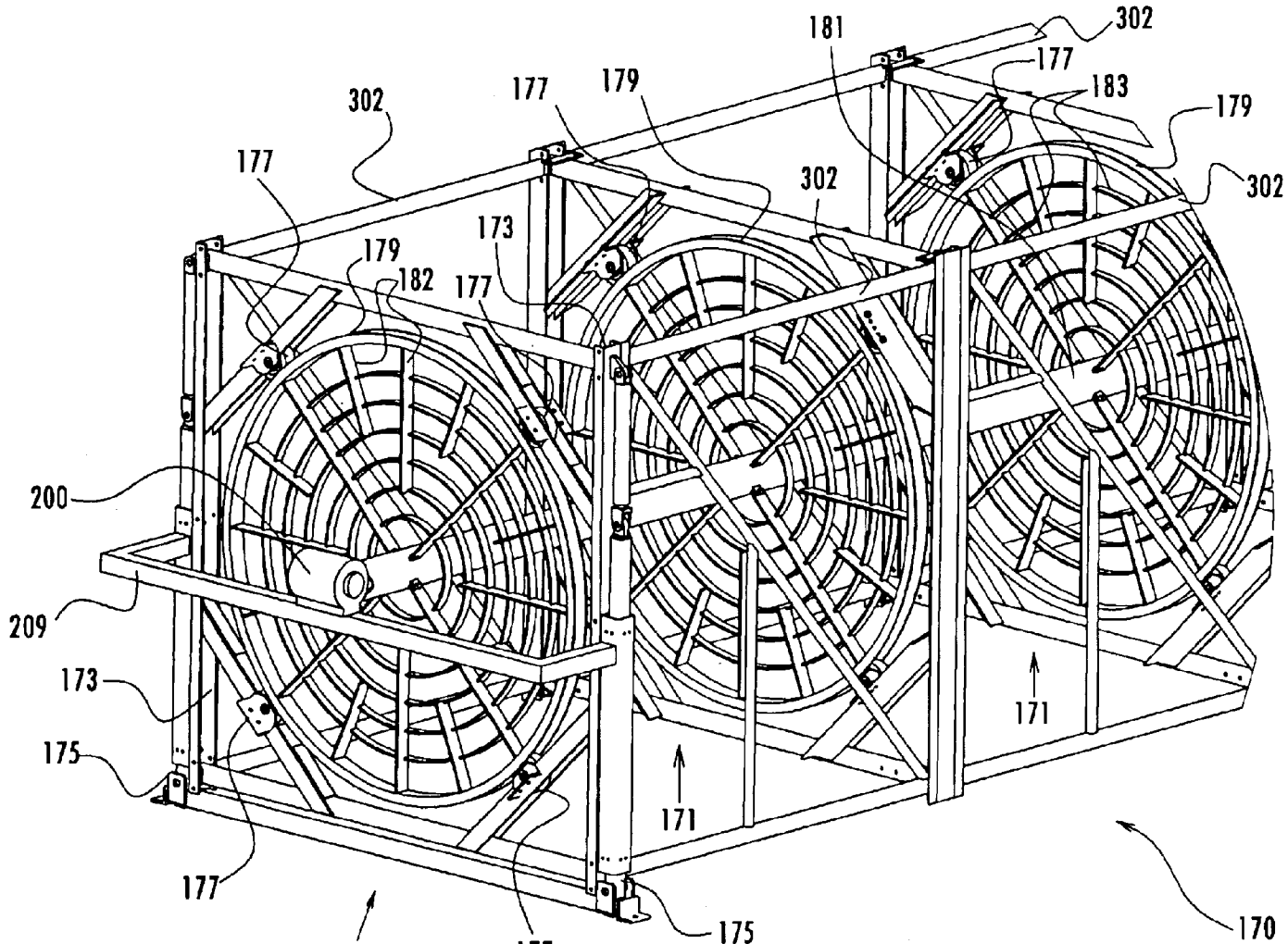
FIG. 16 is a perspective view of a portion of the reinforcing rod support assembly which forms part of the apparatus illustrated in FIG. 14.

A portion of the support assembly 170 which is furthest from the former 40 is illustrated in FIG. 16. The winch previously referred to is designated generally by the numeral 200. The winch 200 is mounted on a frame member 209 which extends from the support assembly 170.

Figure 17:
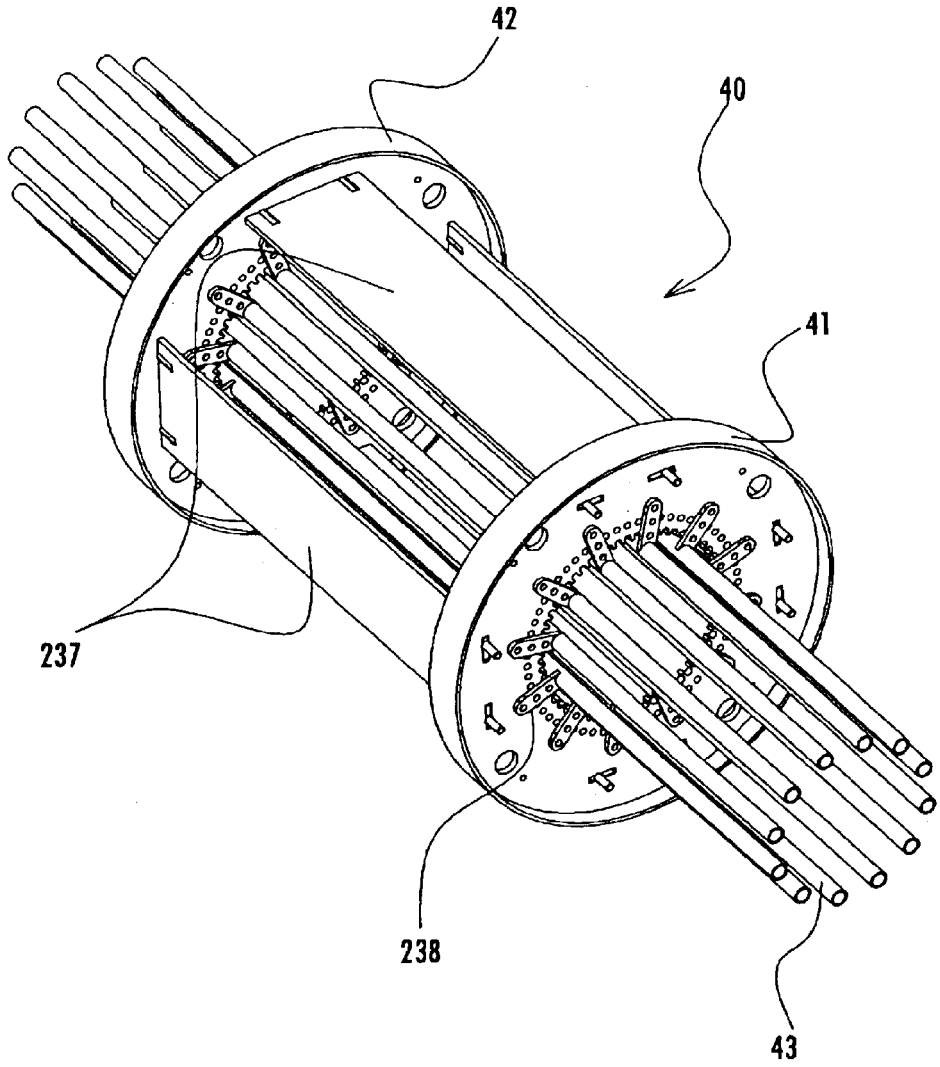
FIG. 17 is a perspective view of the former which forms part of the apparatus illustrated in FIG. 14.

The former 40 is illustrated in FIG. 17. The former 40 includes two annular rings 41 and 42. Brackets 237 interconnect the rings 41 and 42. The rings 41, 42 each have a plurality of apertures (not specifically indicated) which are located near the internal edge of the rings 41, 42. Attached to some of these apertures are brackets 238 which support tubes 43. The position of each bracket 238 (and hence the tubes 43) is adjustable relative to the rings 41 and 42. Thus, a single former 40 can be configured to produce a cages having different cross sections.

Figure 18:
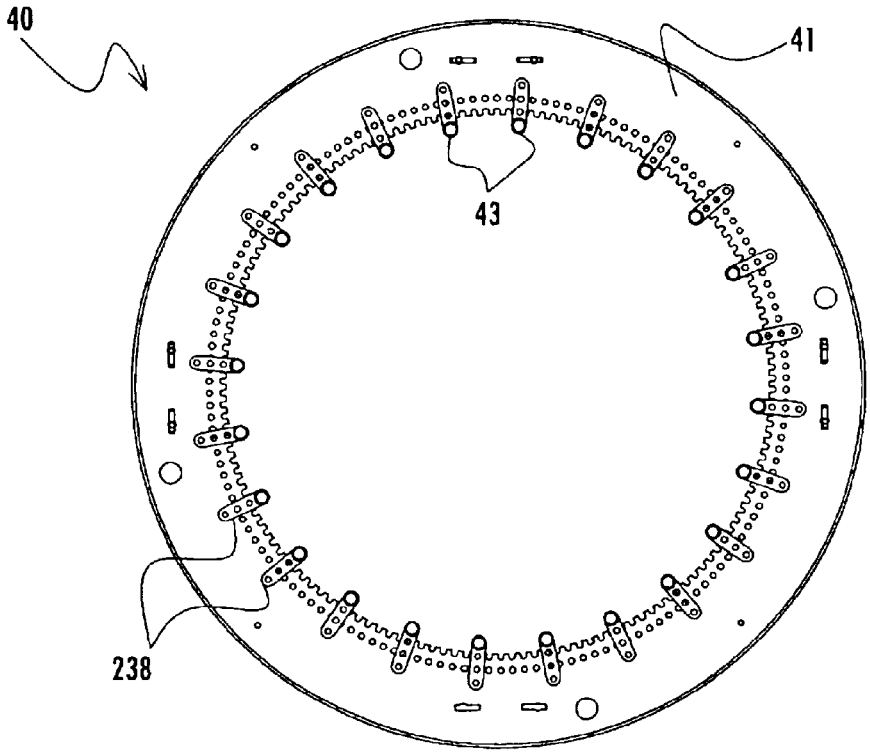
FIG. 18 is an end elevation of a former which is a modified version of the former illustrated in FIG. 17.

Referring to FIG. 18, the former 40 is configured to produce a cage having a circular cross section.

Figure 19:
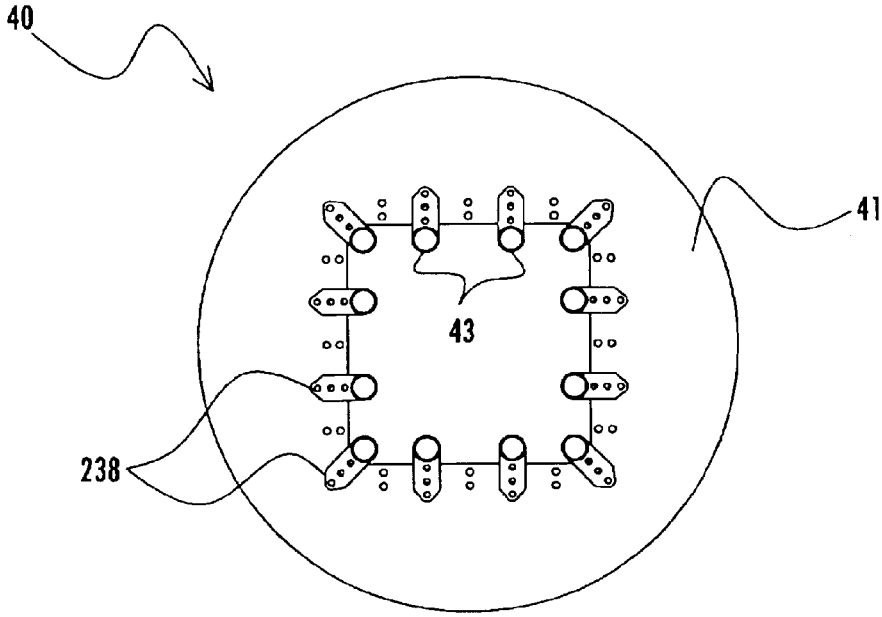
FIG. 19 is an end elevation of a former which is a modified version of the former illustrated in FIG. 17.

Referring to FIG. 19, the former 40 is configured to produce a cage having a square cross section.

Figure 20:
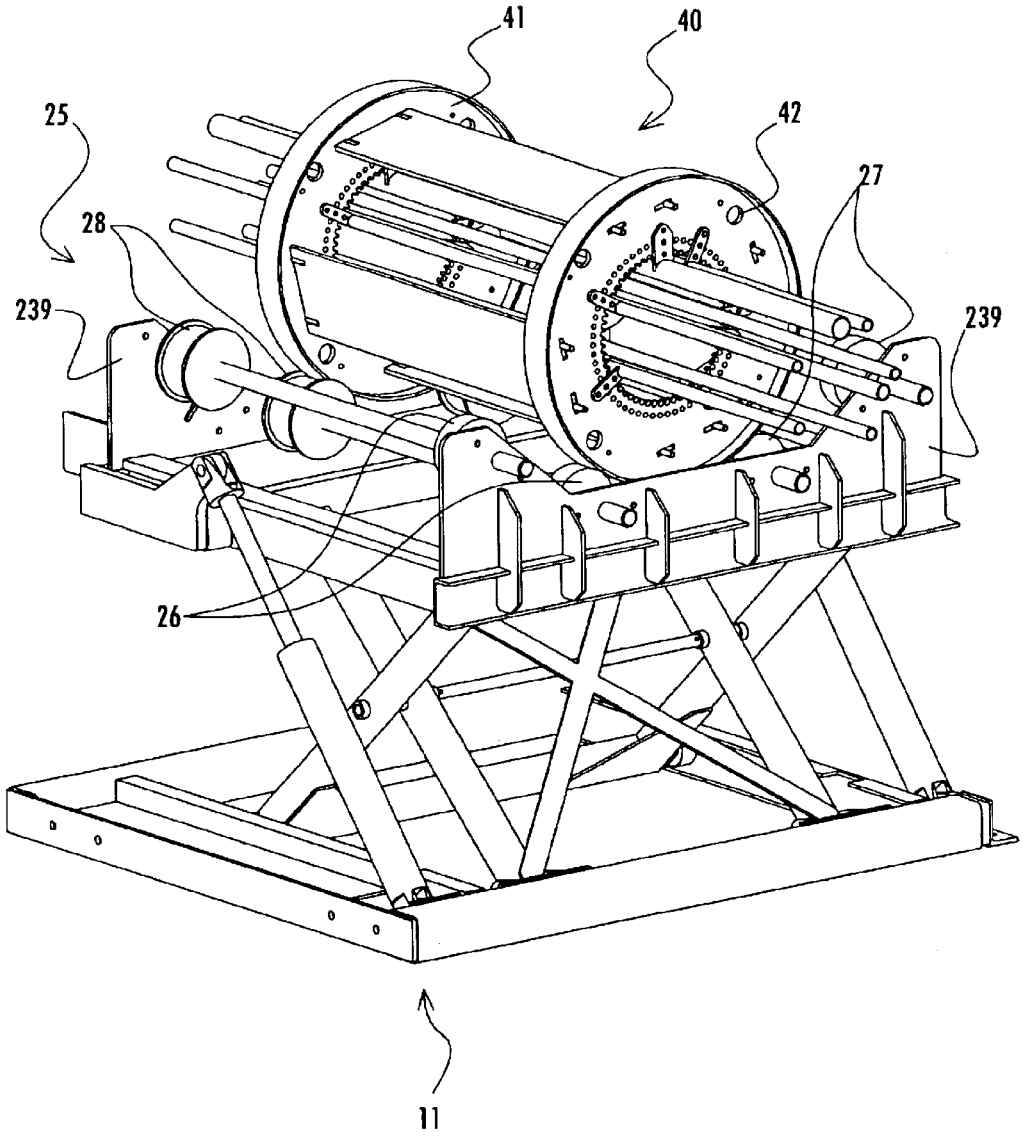
FIG. 20 is a perspective view of the former and frame which form part of the apparatus illustrated in FIG. 14.

With reference to FIG. 20, the former 40 rests upon bed 25 which, in turn, is supported by the frame 11. The bed 25 has rollers 26 to 29 which are mounted on support brackets 239. The rings 41, 42 of the former 40 rest upon the rollers 26 to 29 so that the former 40 is able to rotate upon the bed 25. The support brackets 239 are mounted on the frame 11.

Figure 21:
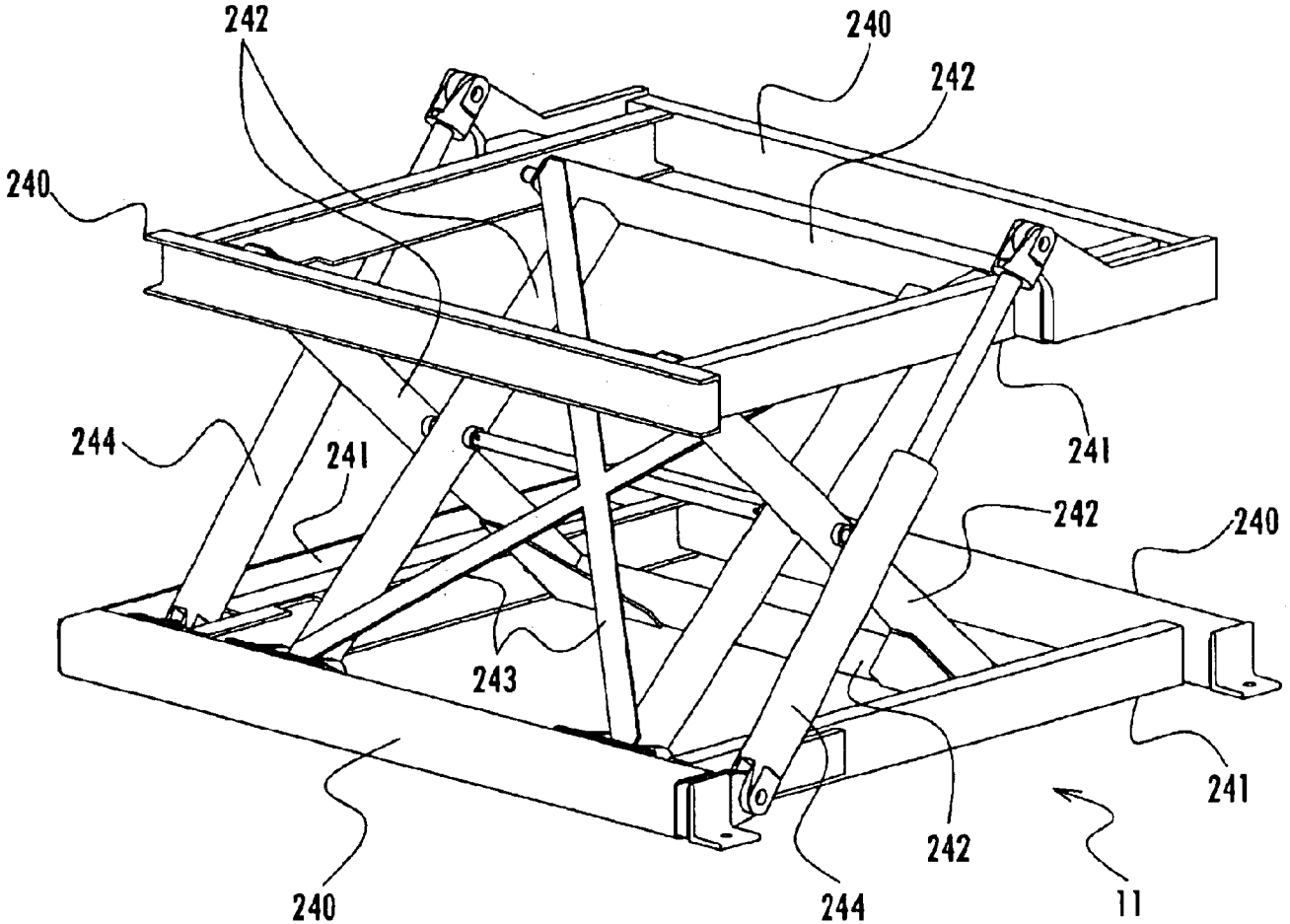
FIG. 21 is a perspective view of the frame which forms part of the apparatus illustrated in FIG. 14, wherein the frame is shown in a raised position.

Referring to FIG. 21, the frame 11 includes two horizontal subframes which are each composed of frame members 240 and 241. The subframes are interconnected by means of an adjustable scissor type mechanism which includes frame members 242 and a brace 243 which is attached to two of the frame members 242. Two of the frame members 242 are pivotally attached to the lower sub-frame and engage with the upper sub-frame by way of rollers (not specifically indicated) which are constrained to roll along the inside of the frame members 241 of the upper sub-frame. Similarly, two frame members 242 are pivotally attached to the upper sub-frame and engage with the lower sub-frame by way of rollers (not specifically indicated) which are constrained to roll along the inside of the frame members 241 of the lower sub-frame. Rams 244 are pivotally attached to the upper and lower sub-frames. The rams 244 are operable to adjust the height of the frame 11. The rams 244 are shown extended so that the sub-frames are spaced apart from each other.

Figure 22:
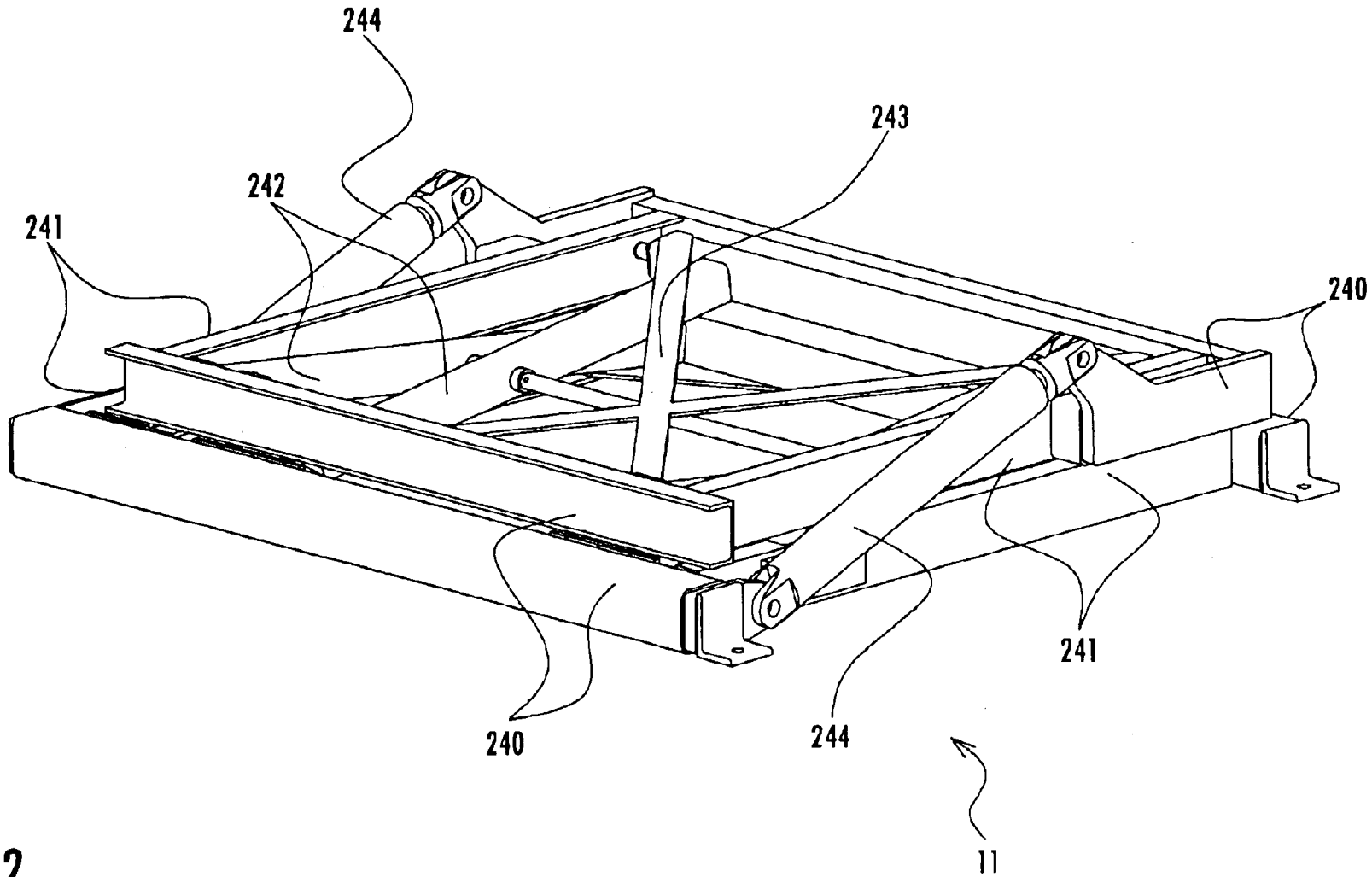
FIG. 22 is a perspective view of the frame which forms part of the apparatus illustrated in FIG. 14, wherein the frame is shown in a lowered position.

Referring to FIG. 22, the rams 244 are retracted so that the sub-frames of the frame 11 rest against each other. Positions intermediate to those illustrated in FIGS. 21 and 22 are also possible.

Figure 23:
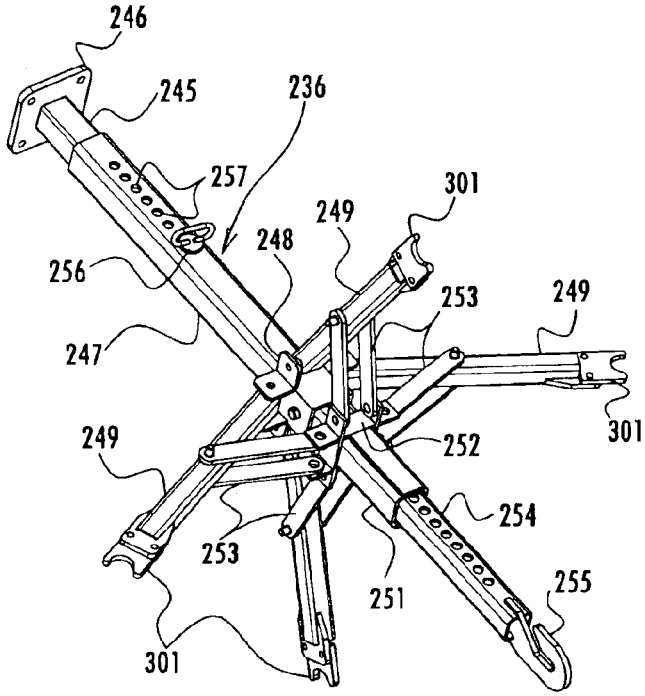
FIG. 23 is a perspective view of a portion of the cage clamp which forms part of the apparatus illustrated in FIG. 14, wherein the cage clamp is shown configured for engagement with a cage.
Figure 24:
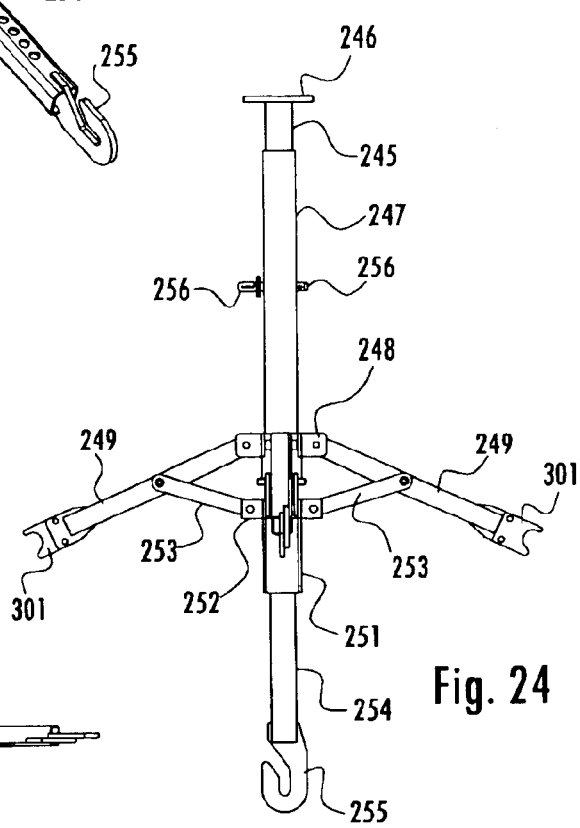
FIG. 24 is a front elevation of the cage clamp illustrated in FIG. 23.
Figure 25:
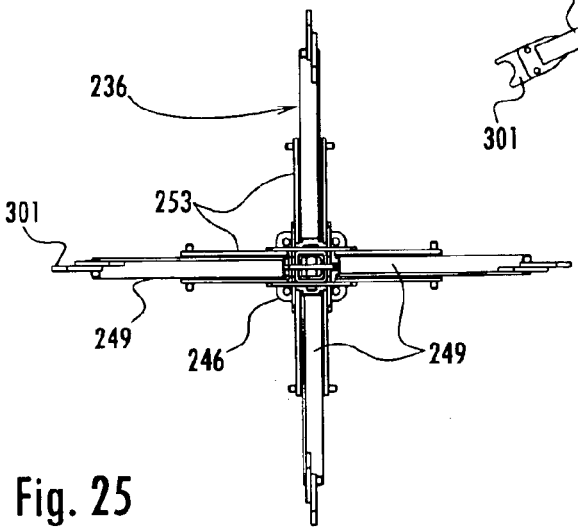
FIG. 25 is an end elevation of the cage clamp illustrated in FIG. 23.

Referring to FIGS. 23 to 25, the cage clamp 236 includes a hollow member 245 which is received by and rotationally locks with a hollow member 247. A flange 246 extends from a distal end of member 245. The flange 246 enables the cage clamp 236 to be attached to the third axle 204. A plurality of apertures 257 extend through adjacent sides of the members 245 and 247. The apertures 257 enable the members 245 and 247 to be fixed in position relative to each other with the aid of a pin 256. A bracket 248 fixed to an end of member 247.

A hollow member 251 is received by and rotationally locks with the member 247. Member 251 is slidable with respect to the member 247 and is retained relative to the member 247 by a retaining pin (not specifically indicated). A bracket 252 is fixed to member 251.

A plurality of cage engaging members are pivotally attached to the member 247. Each cage engaging member includes a tine 249 and a cage engaging portion 301 which extends from the tine 249. A first end of each tine 249 is pivotally attached to the bracket 248. Braces 253 are pivotally attached to the tines 249 and the bracket 252. This arrangement enables the tines 249 to be opened or collapsed. The position of pin 256 relative to members 245 and 247 governs the amount by which the tines 249 are opened. A hollow member 254 is received by and rotationally locks with the member 251. A hook 255 extends from an end of the member 254.

Figure 26:
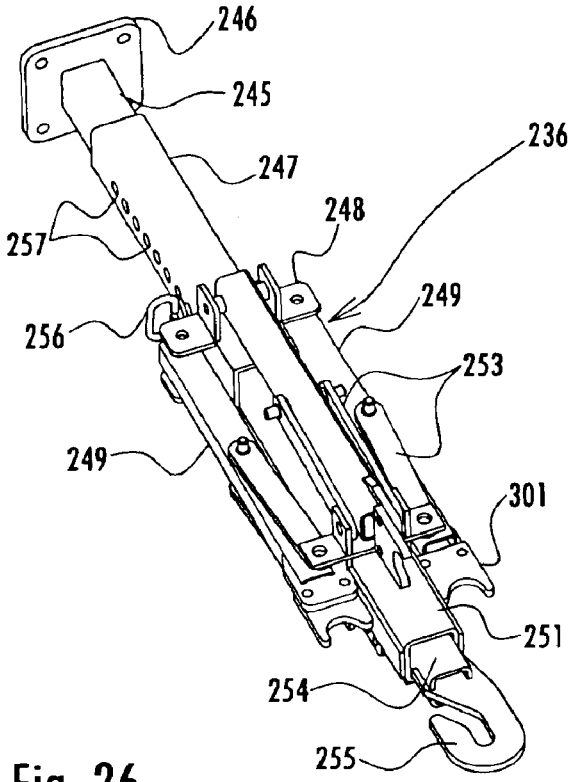
FIG. 26 is a perspective view of the cage clamp which forms part of the apparatus illustrated in FIG. 14, wherein the cage clamp is shown in a collapsed configuration.
Figure 27:
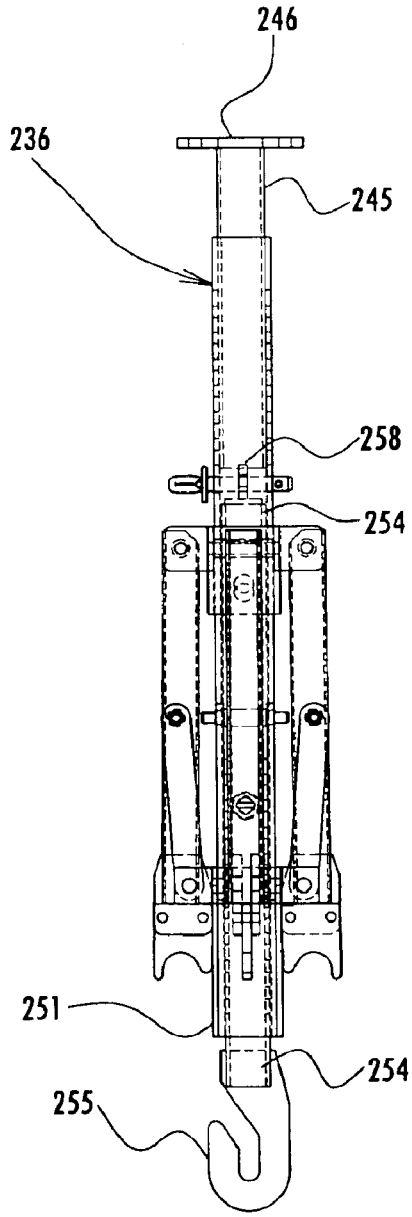
FIG. 27 is a front elevation of the cage clamp illustrated in FIG. 26.
Figure 28:
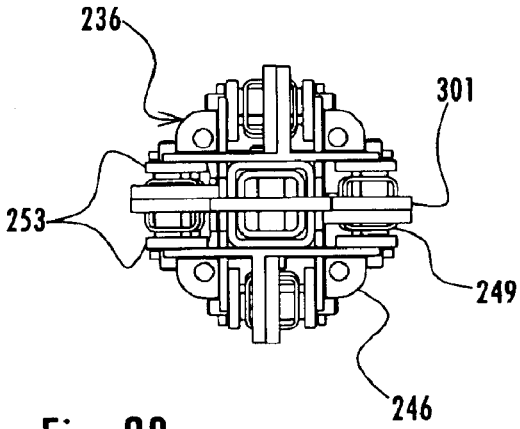
FIG. 28 is an end elevation of the cage clamp illustrated in FIG. 26.

Referring to FIGS. 26 to 28, the tines 249 have been collapsed. A shackle 258 enables the cable from the winch 200 to be linked with the clamp 236.

Figure 29:
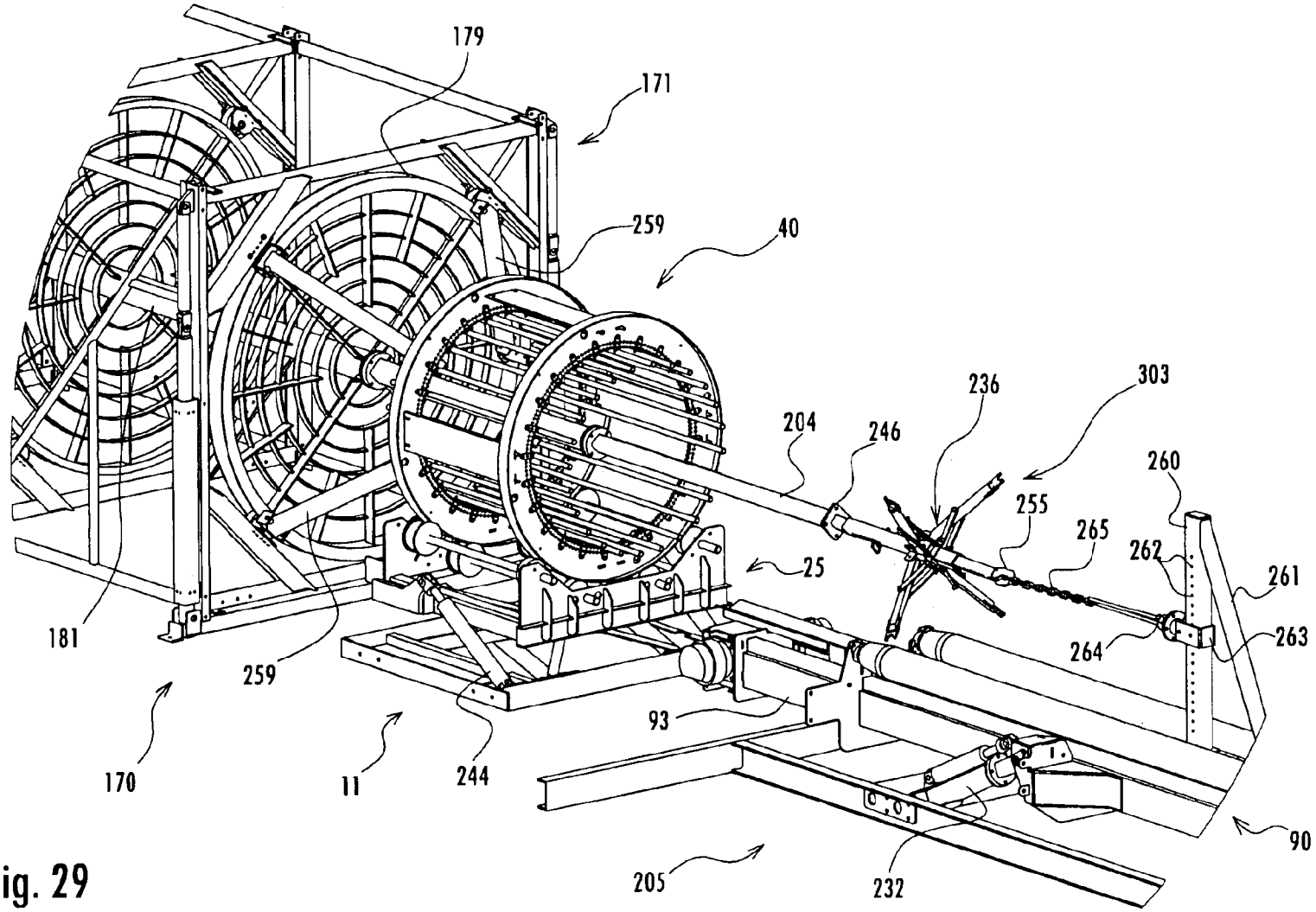
FIG. 29 is a perspective view of a portion of the apparatus illustrated in FIG. 14, wherein the apparatus has been configured to accommodate a larger former and the cage holder extends through the former.

Referring to FIG. 29, the apparatus 10 of FIG. 14 has been modified to include rods 259 which interconnect the former 40 and the support disc 179 of the adjacent support assembly spider 171. This arrangement enables the former 40 and the support disc 179 to rotate in unison with each other.

Also, the former 40 has a larger diameter. To compensate for this, the bed 25 has been lowered by reducing the height of the frame 11. Also, the loading module 90 has been lowered by increasing the inclination of the frame members 232.

A chain 265 couples the cage clamp 236 to a rotatable hub 264 which is mounted to the upright 260 of the shuttle 92 by a bracket 263. Apertures 262 in the upright 260 enable the height of the bracket 263 to be adjusted. A brace 261 supports the upright 260.

Figure 30:
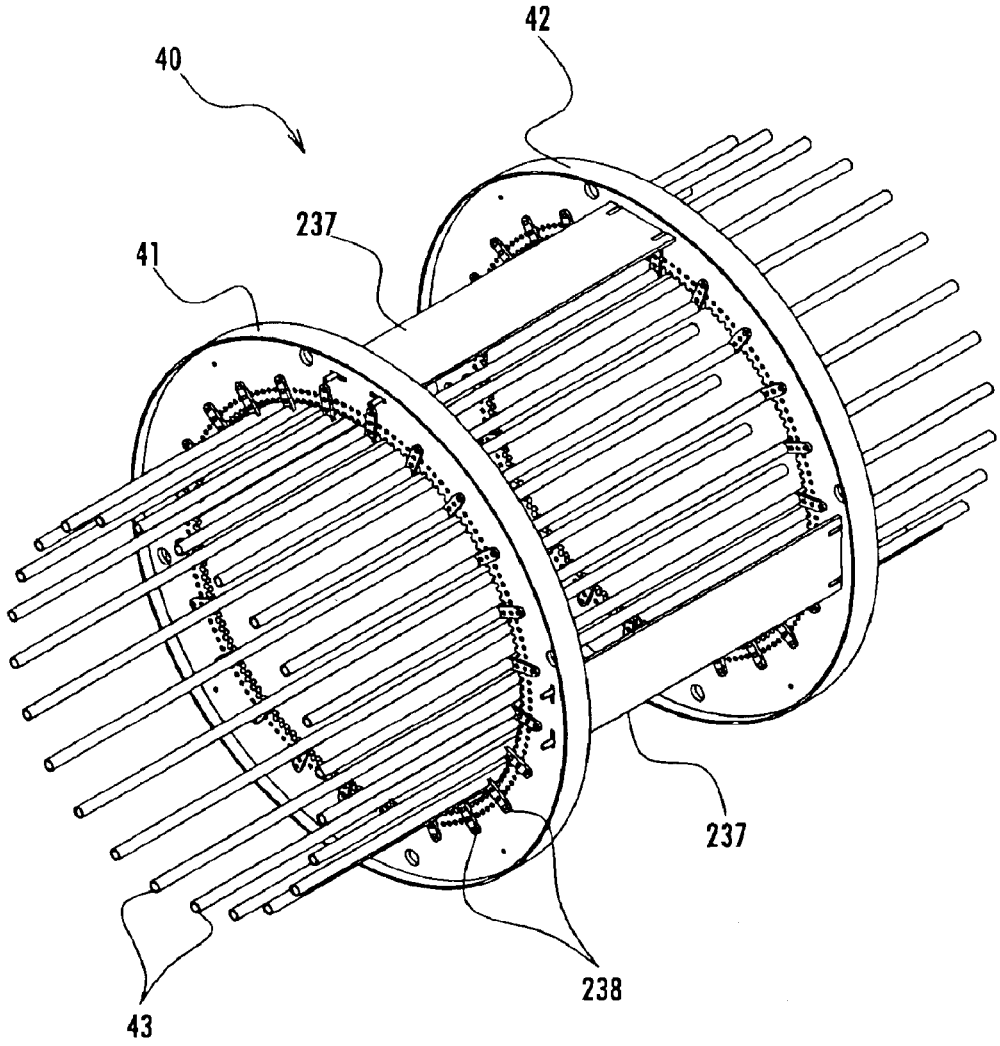
FIG. 30 is a perspective view of a variation of the former which forms part of the apparatus illustrated in FIG. 29.

The former 40 used in the apparatus 10 of FIG. 29 is shown in FIG. 30. Apart from the larger rings 41 and 42, the construction of the former 40 is substantially the same as the former 40 illustrated in FIG. 17.

Figure 31:
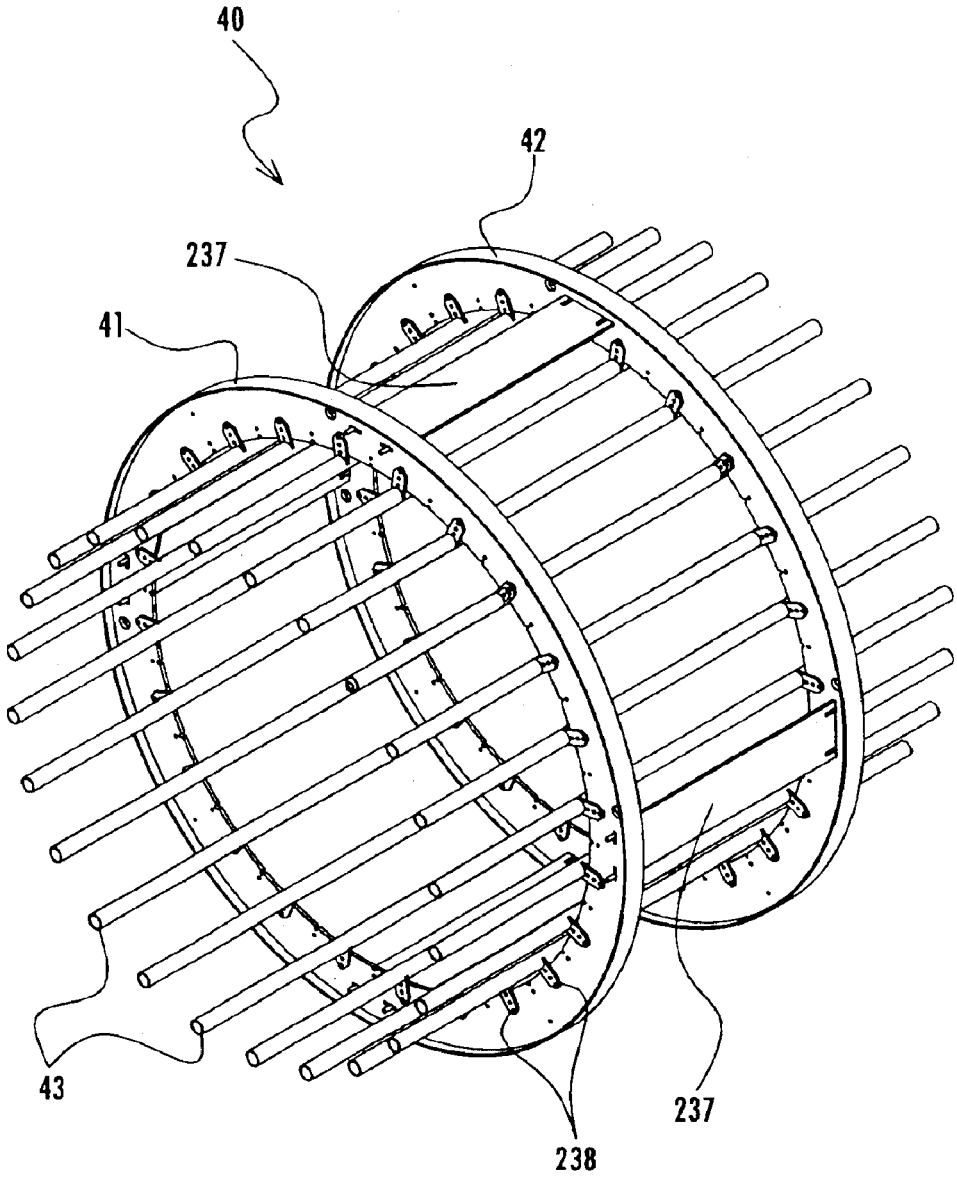
FIG. 31 is a perspective view of a variation of the former which forms part of the apparatus illustrated in FIG. 29.

FIG. 31 illustrates a former 40 which has different dimensions compared to the former 40 illustrated in FIG. 30.

Figure 32:
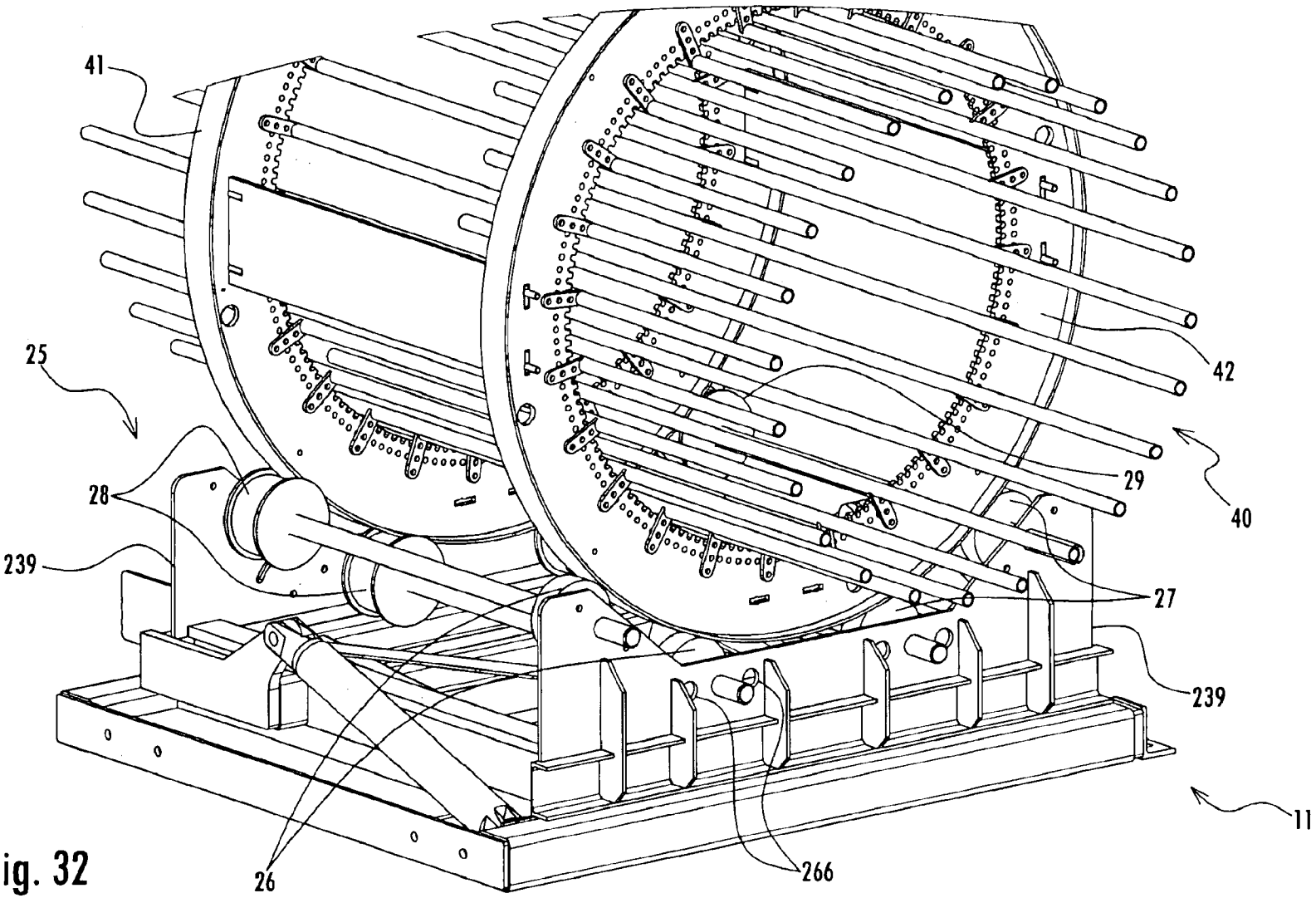
FIG. 32 is a perspective view of the former and the frame which form part of the apparatus illustrated in FIG. 29, wherein the frame is in a lowered position.

FIG. 32 illustrates how the rings 41, 42 of the former 40 rest upon the rollers 26 to 29 of the bed 25. The position of some of the rollers 26 to 29 can be adjusted by mounting those rollers 26 to 29 to different mounting apertures 266.

Figure 33:
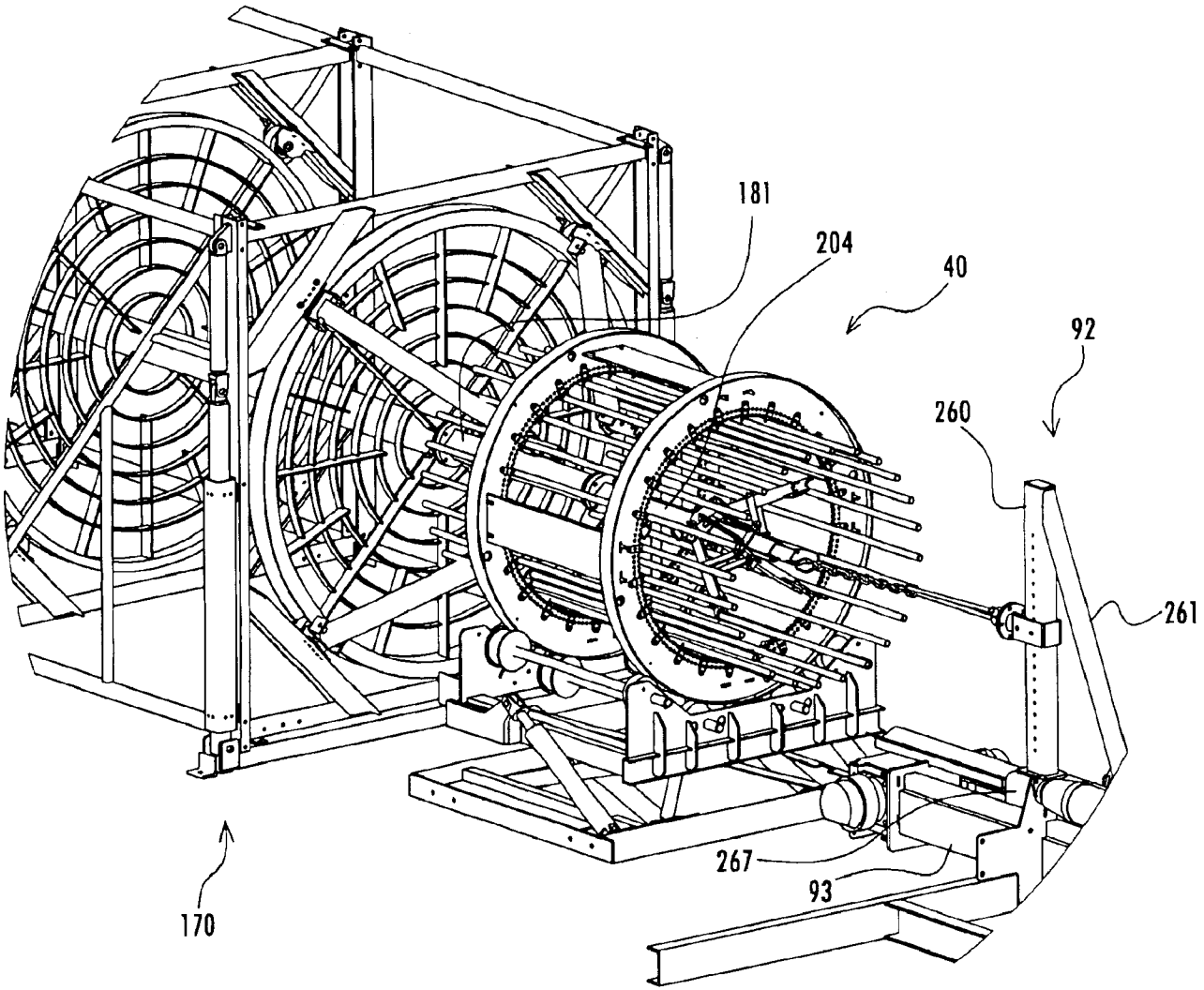
FIG. 33 is a perspective view of the apparatus illustrated in FIG. 29 which shows the cage clamp retracted into the former.

FIG. 33 is similar to FIG. 29 except that the clamp 236 has been retracted into the former 40. As previously mentioned, this is accomplished by retracting the third axle 204 into the second axle 181.

Also shown in FIG. 33 is a support member 267 of the shuttle 92. Upright 260 and brace 261 are attached to the support member 267. The support member 267 is moveable along the shuttle support 93.

Figure 34:
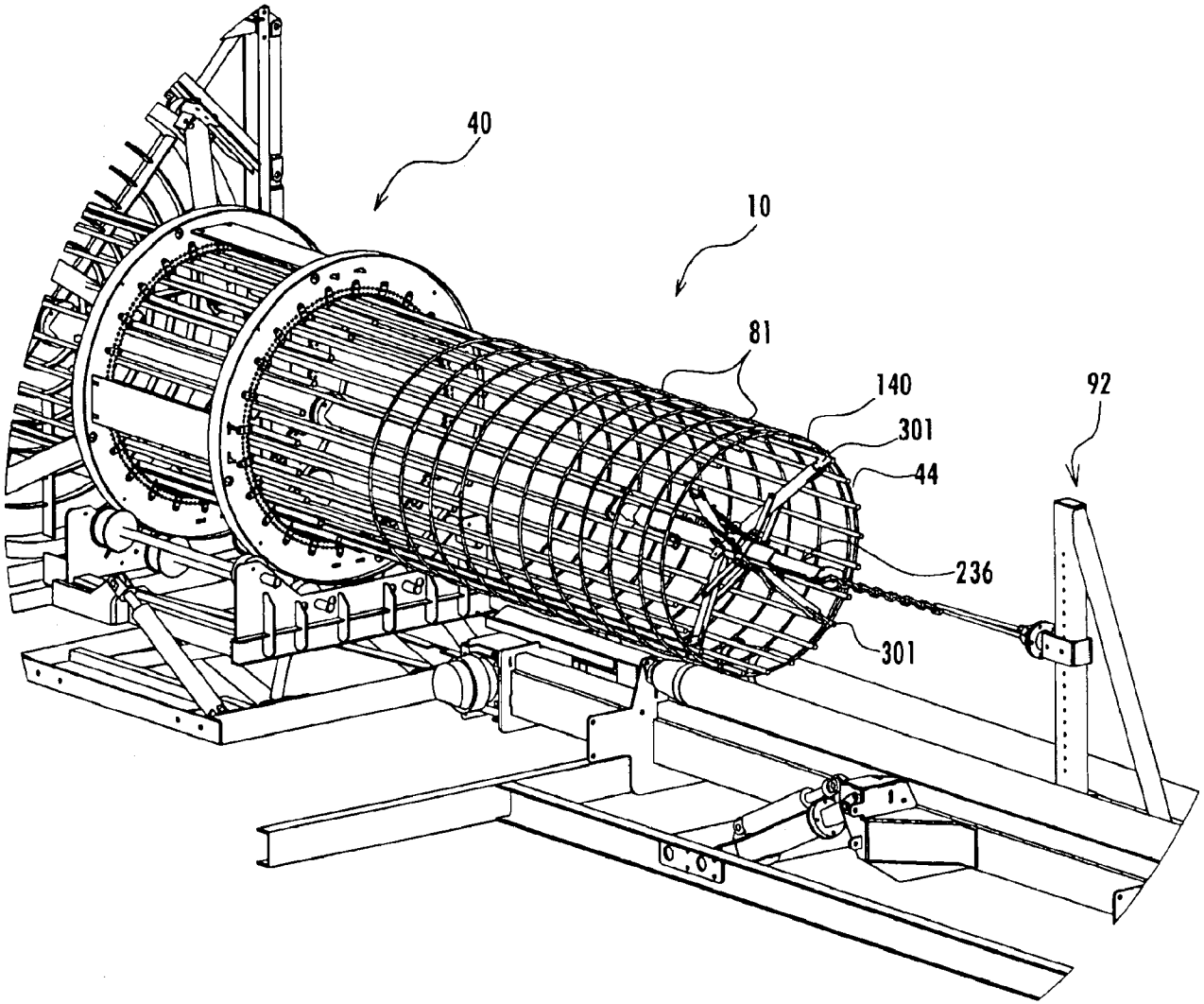
FIG. 34 is a perspective view illustrating the construction of a cage using the apparatus illustrated in FIG. 29.

FIG. 34 illustrates the construction of a cage using the apparatus 10. The clamp 236 is configured so that portions 301 engage with a band 140 which is welded to the reinforcing rods 44. As a reinforcing band 81 is fed around the reinforcing rods 44, the shuttle 92 progressively withdraws the reinforcing rods from the former 40 and the support assembly 170.

Figure 35:
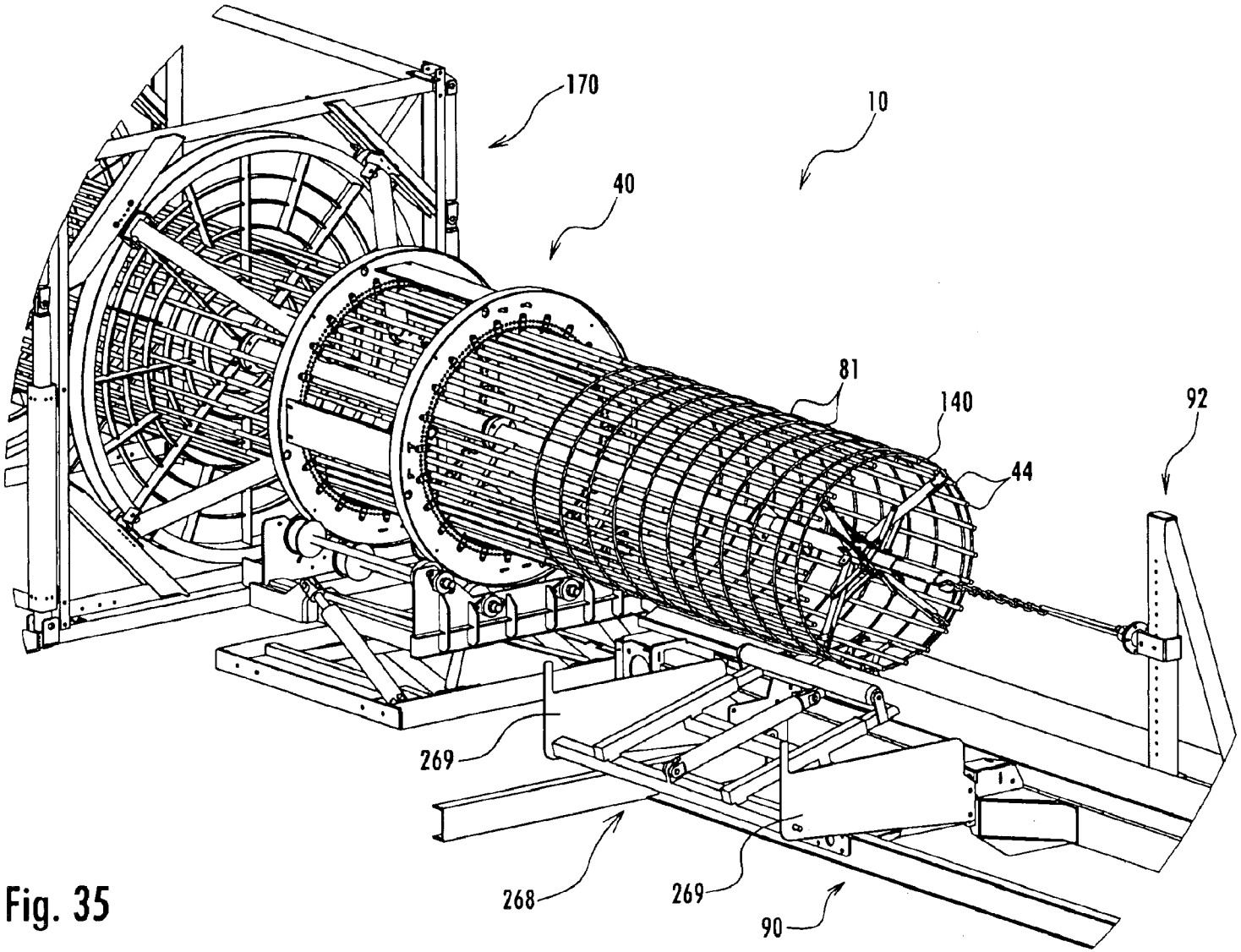
FIG. 35 is a partial perspective view of the apparatus illustrated in FIG. 29, wherein the apparatus has been modified to include an ejection module.

The apparatus 10 illustrated in FIG. 35 is essentially the same as the apparatus 10 of FIG. 34 except that the apparatus 10 of FIG. 35 also has an ejection module 268 mounted to the loading module 90 via support plates 269. The ejection module 268 functions as a means of providing further support for cages during their construction in the apparatus 10 and also as a means of ejecting completed cages from the apparatus 10.

Figure 36:
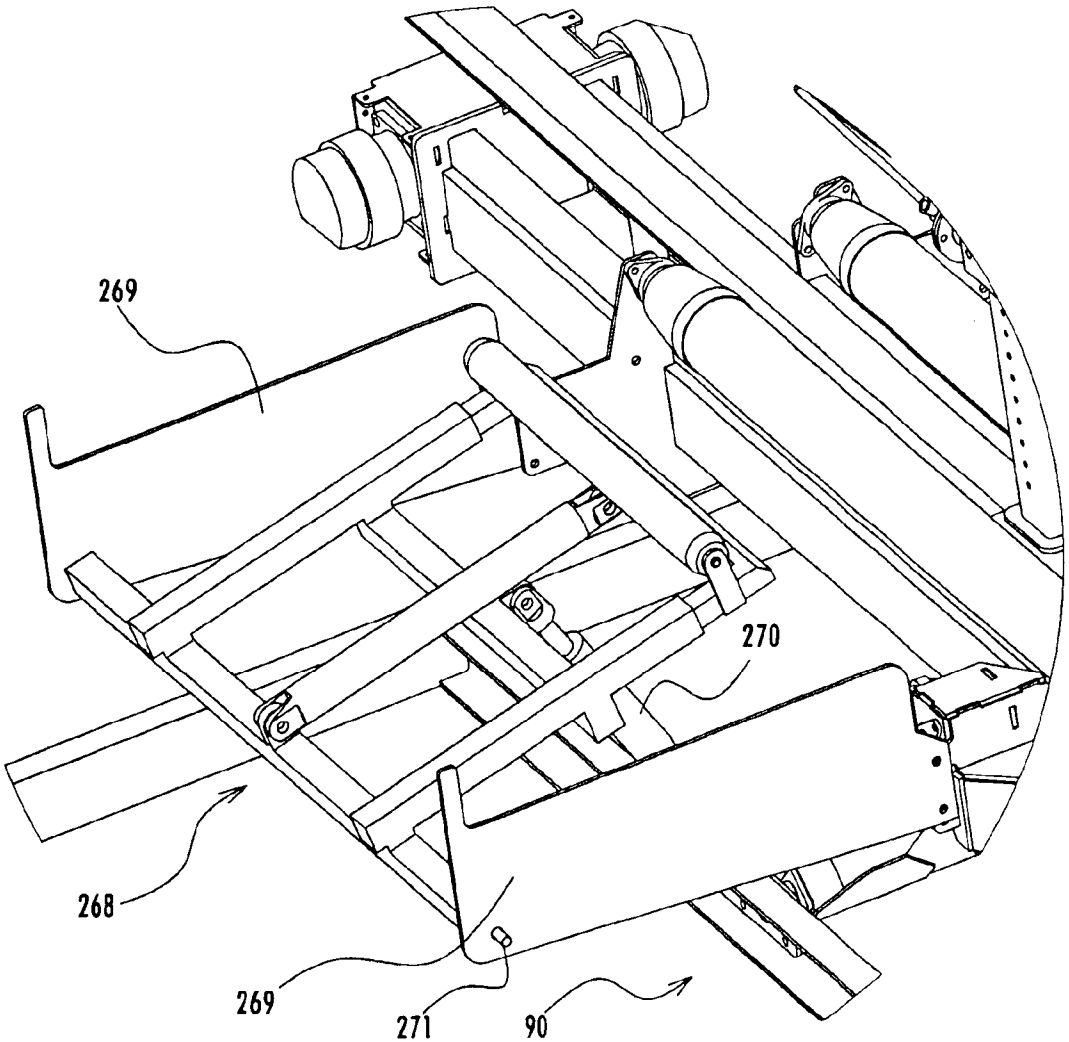
FIG. 36 is a perspective view of the ejection module which forms part of the apparatus illustrated in FIG. 35.

Further detail of the ejection module 268 is shown in FIG. 36. It can be seen that hinges 271 attach the ejection module 268 to the support plates 269. A ram 270 also connects the ejection module 268 to the loading module 90.

Figure 37:
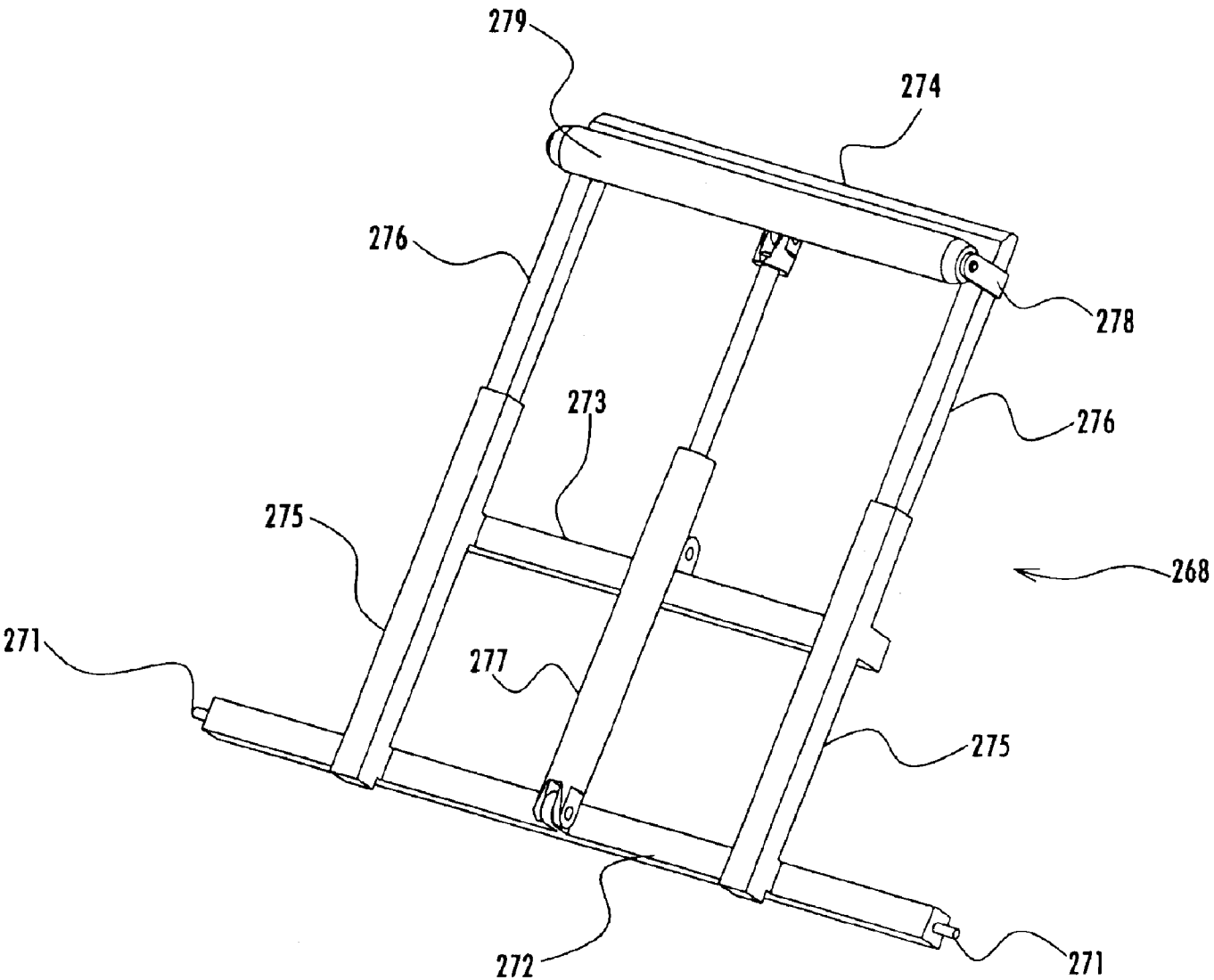
FIG. 37 is a perspective view of the ejection module illustrated in FIG. 36 which shows the ejection module in the extended position.

With reference to FIG. 37, the ejection module 268 comprises frame members 272 and 273 which are interconnected via frame members 275. Frame members 275 are hollow so that frame members 276 can be retracted into the frame members 275. A frame member 274 interconnects distal ends of the frame members 276. A roller 279 is mounted to each frame member 276 by brackets 278. A ram 277 connects frame member 272 to frame member 274 so that frame members 274 and 276 can be extended and retracted relative to frame members 272, 273 and 275.

Figure 38:
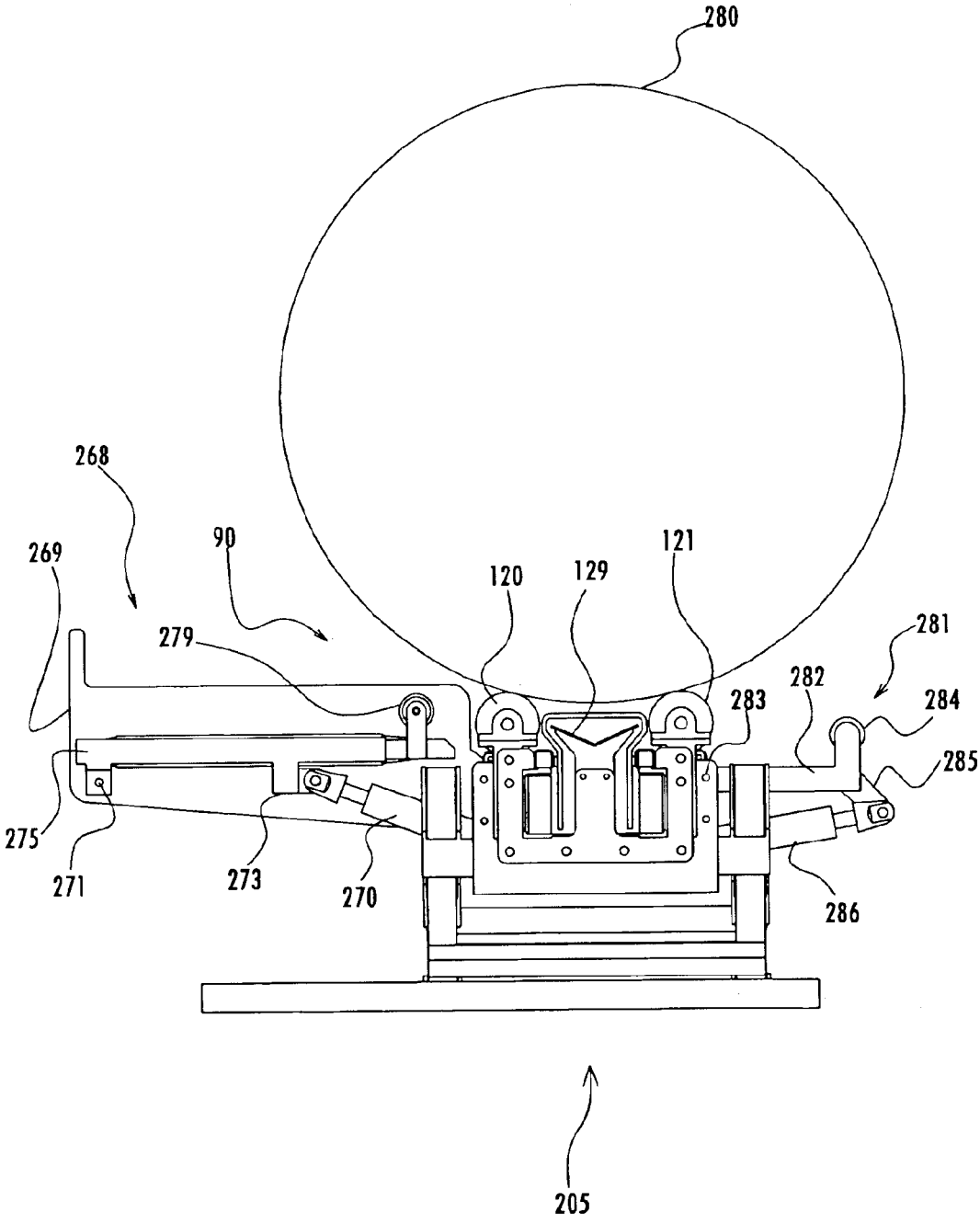
FIG. 38 is an end elevation of the apparatus illustrated in FIG. 35 which shows the ejection module and a support module in a first position.

An end view of the apparatus 10 of FIG. 35 is illustrated in FIG. 38. A cage 280 rests on rollers 120 and 121. A support module 281 having frame members 282 and 285, a roller 284 and a ram 286 provides additional cage support on the opposite side of the loading module 90 to the ejection module 268.

Figure 39:
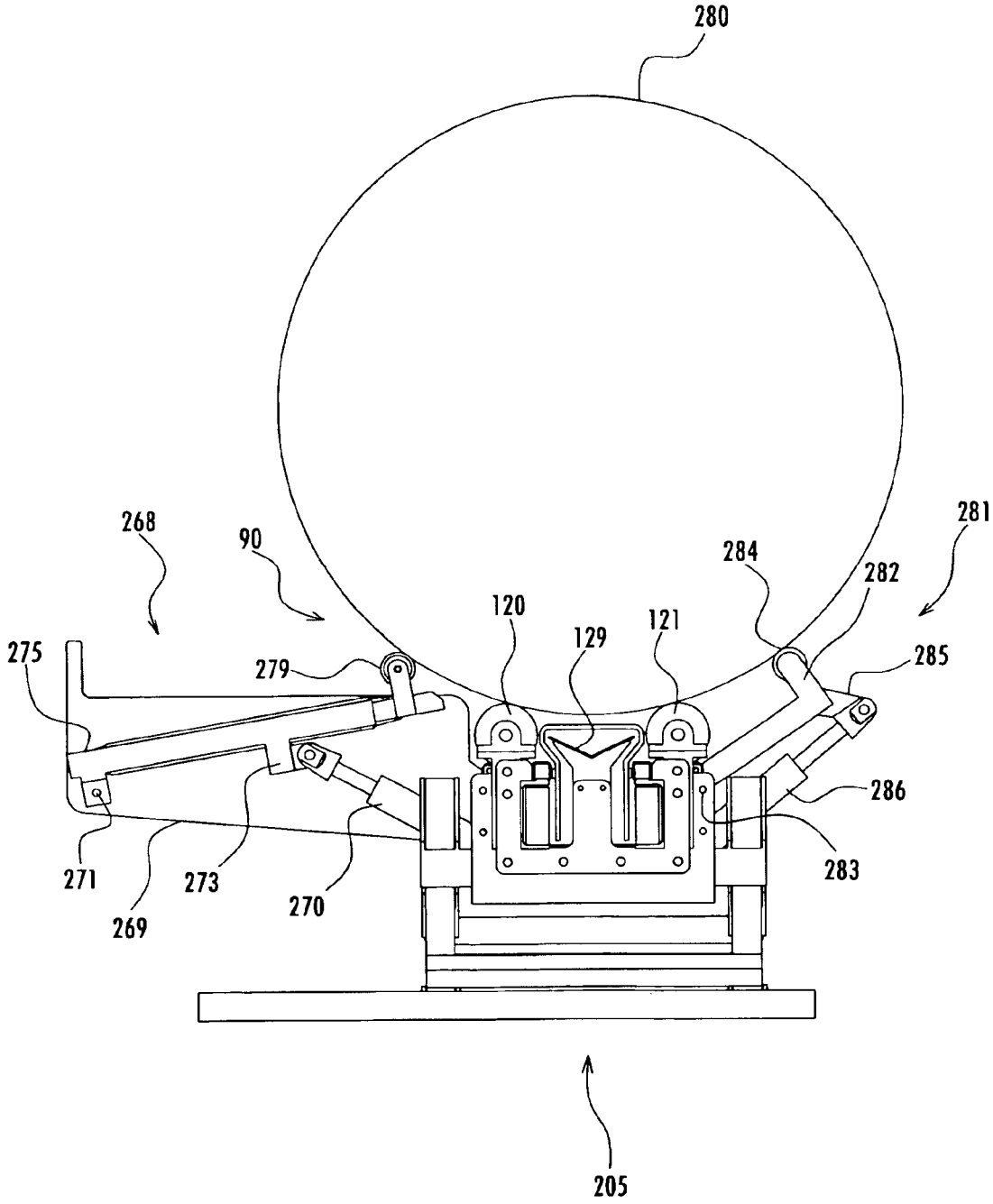
FIG. 39 is an end elevation of the apparatus illustrated in FIG. 35 which shows the ejection module and a support module in a second position.

FIG. 39 illustrates how the ejection module 268 and the support module 281 provide additional support for the cage 280. Rollers 279 and 284 engage with the exterior of the cage 280.

Figure 40:
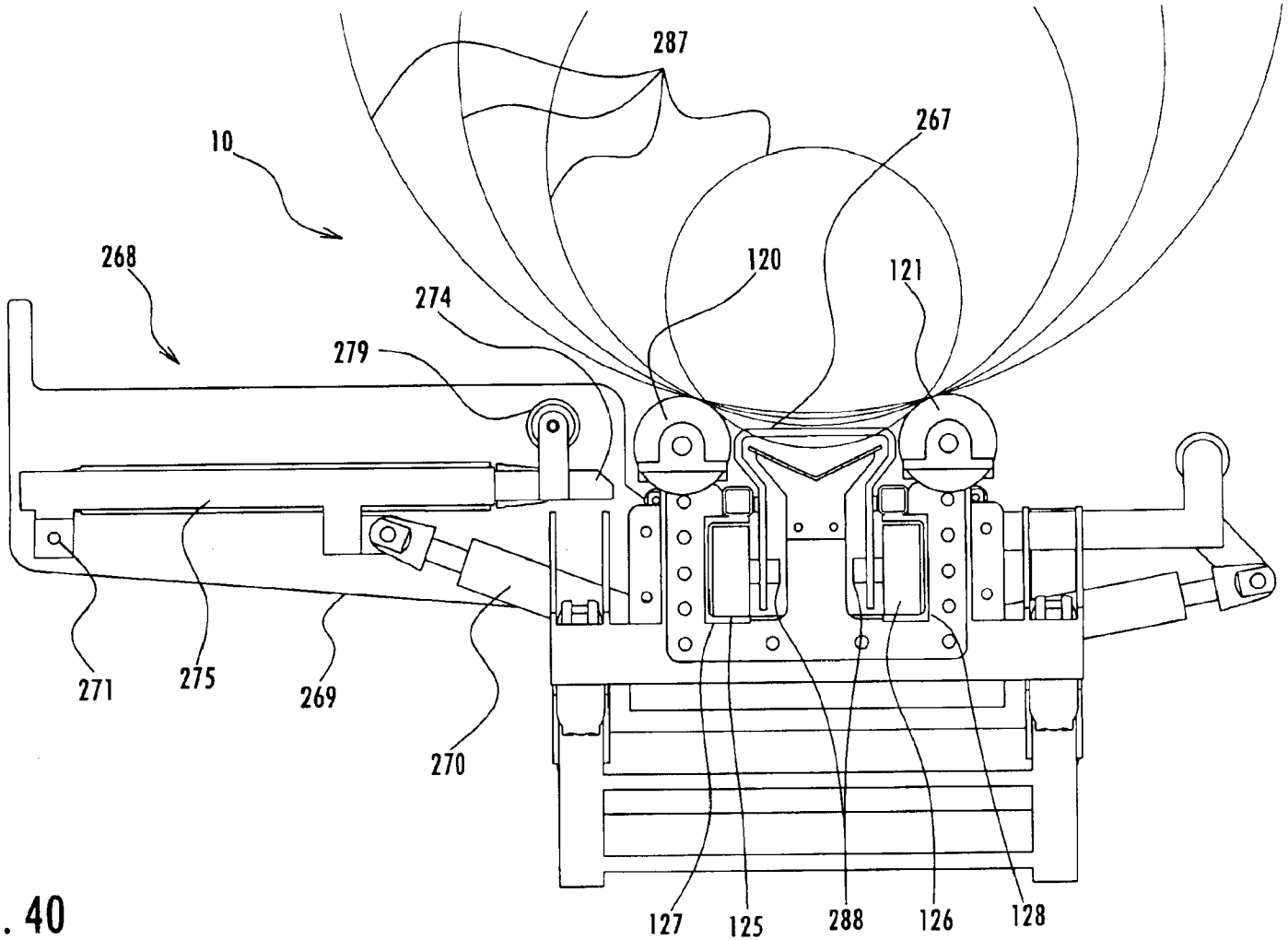
FIG. 40 is a detailed end elevation of the apparatus illustrated in FIG. 35 which shows the ejection module in a first position.

FIG. 40 illustrates how the apparatus 10 accommodates cages 287 of various diameters. Also shown are guide rollers 125 and 126 which are received within longitudinally extending rails 127 and 128. Axles 288 mount the guide rollers 125 and 126 to the support member 267 of the shuttle 92. The ejection module 268 is shown in a first position.

Figure 41:
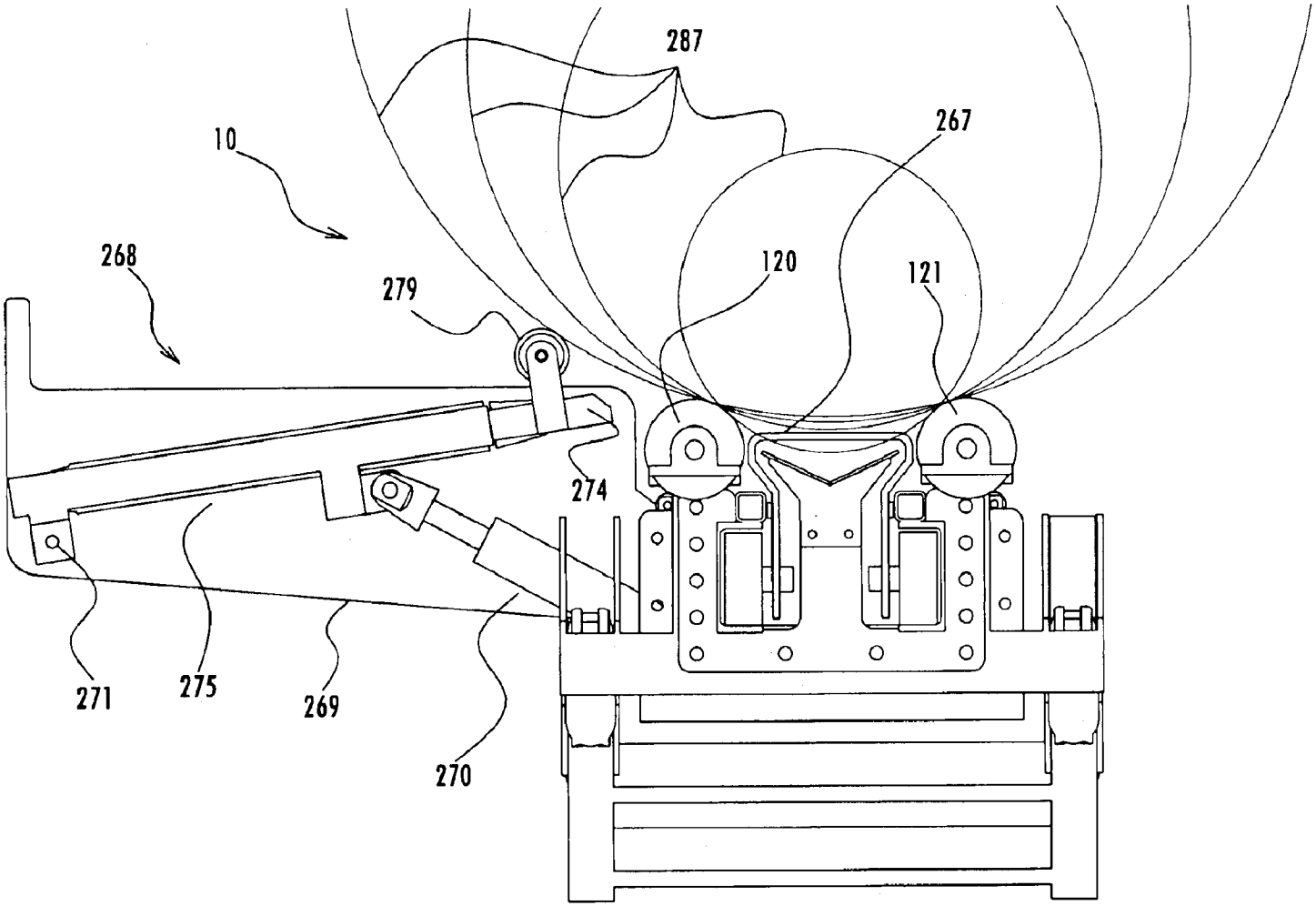
FIG. 41 is a detailed end elevation of the apparatus illustrated in FIG. 35 which shows the ejection module in a second position.

FIG. 41 illustrates the apparatus 10 of FIG. 40 when the ejection module 268 is configured so that the roller 279 will engage with the exterior of a cage 287 having a large diameter. It can be seen that the ram 270 pivots the ejection module 268 about hinge 271.

Figure 42:
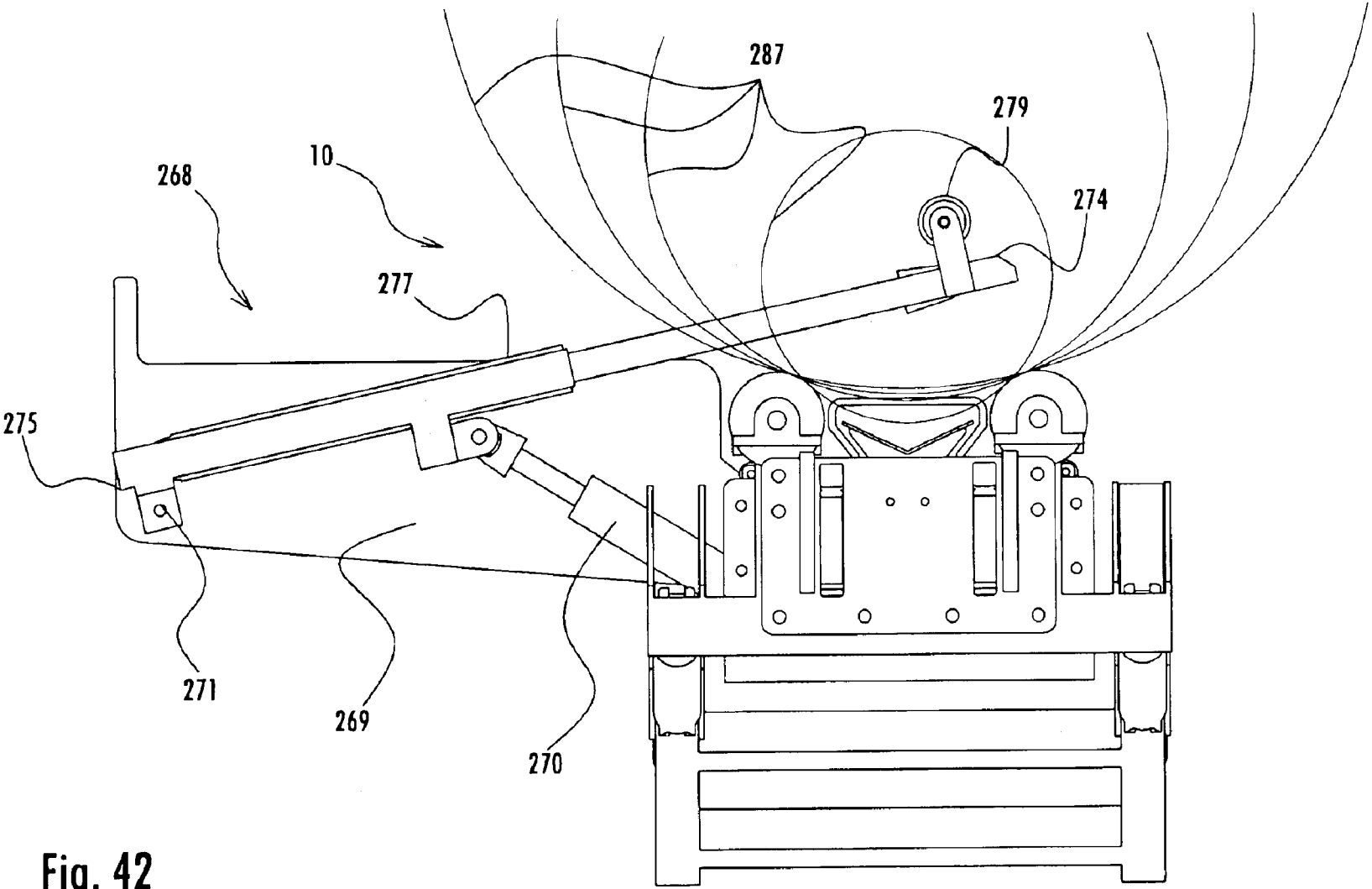
FIG. 42 is a detailed end elevation of the apparatus illustrated in FIG. 35 which shows the ejection module in a third position.

FIG. 42 illustrates the apparatus 10 of FIG. 41 when the ejection module 268 is ejecting a cage 287 from the loading module 90. It can be seen that the ram 277 is extended so that frame member 274 will push the cage 287 off the loading module 90.

Figure 43:
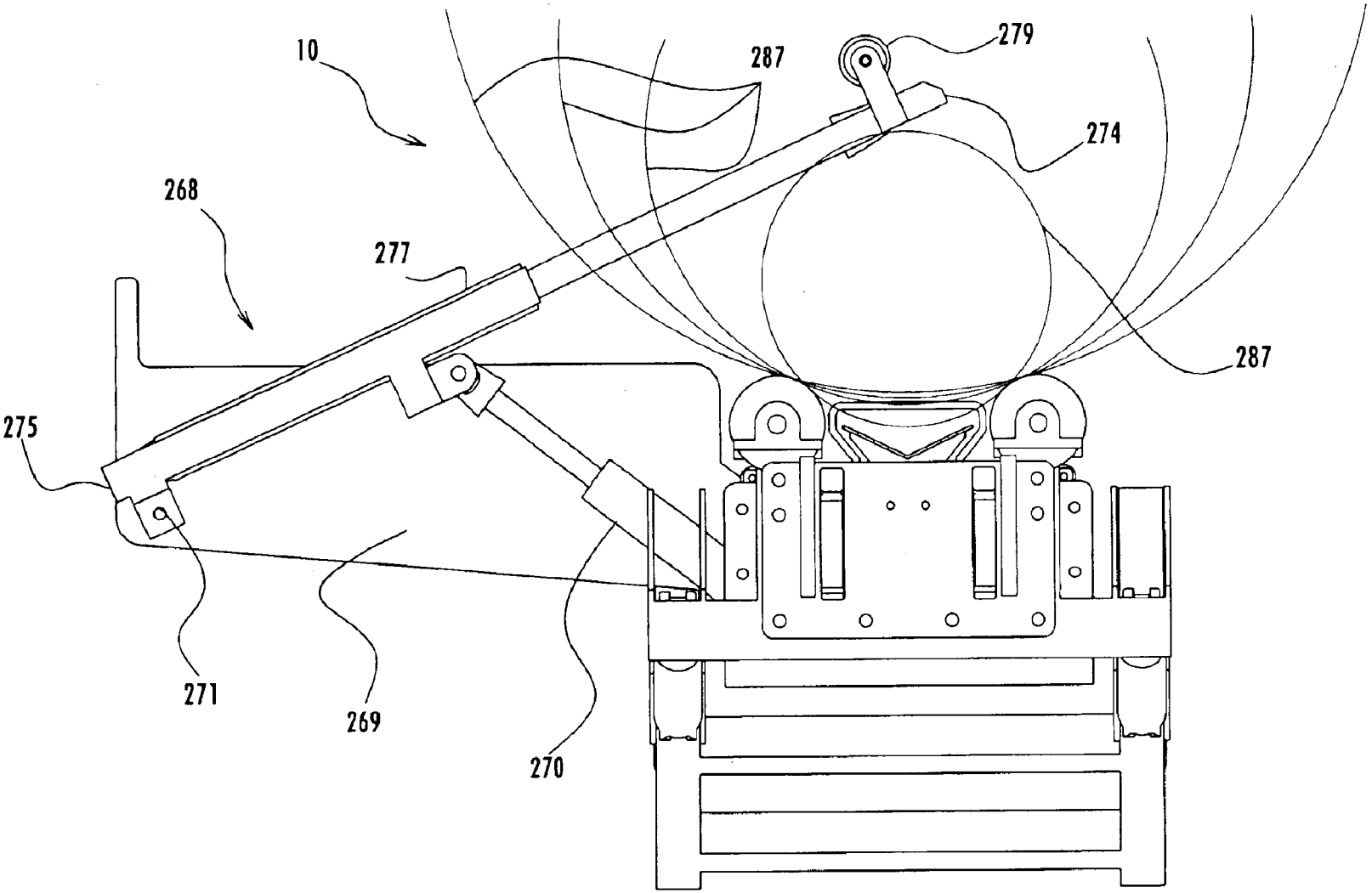
FIG. 43 is a detailed end elevation of the apparatus illustrated in FIG. 35 which shows the ejection module in a fourth position.

FIG. 43 illustrates the apparatus 10 of FIG. 43 when the frame member 274 is raised during the ejection of a cage 287.

Figure 44:
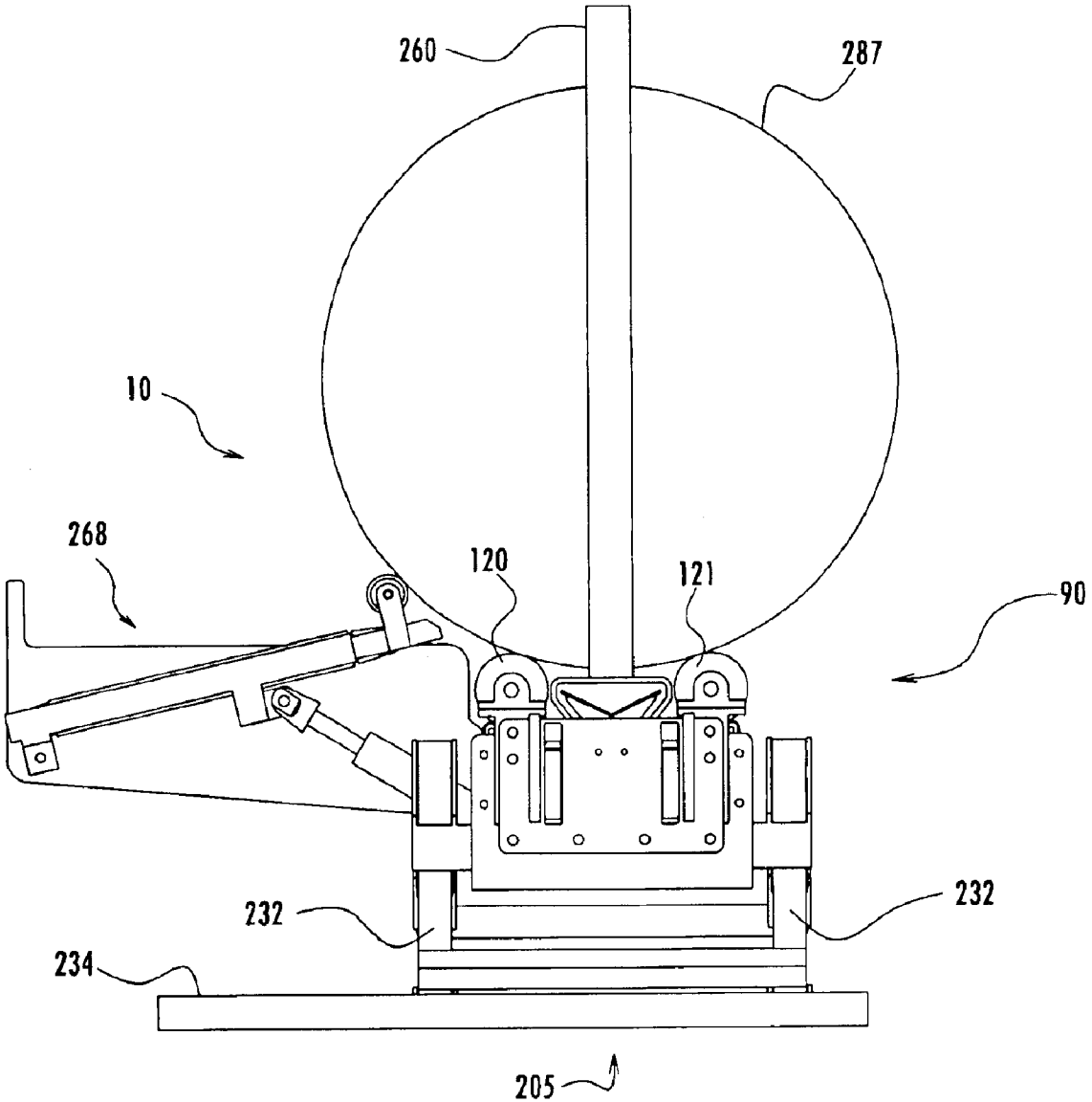
FIG. 44 is an end elevation of the apparatus illustrated in FIG. 35 which shows the loading module in a lowered position.

An end view of the apparatus 10 of FIG. 35 in which the loading module 90 has been lowered is illustrated in FIG. 44.

Figure 45:
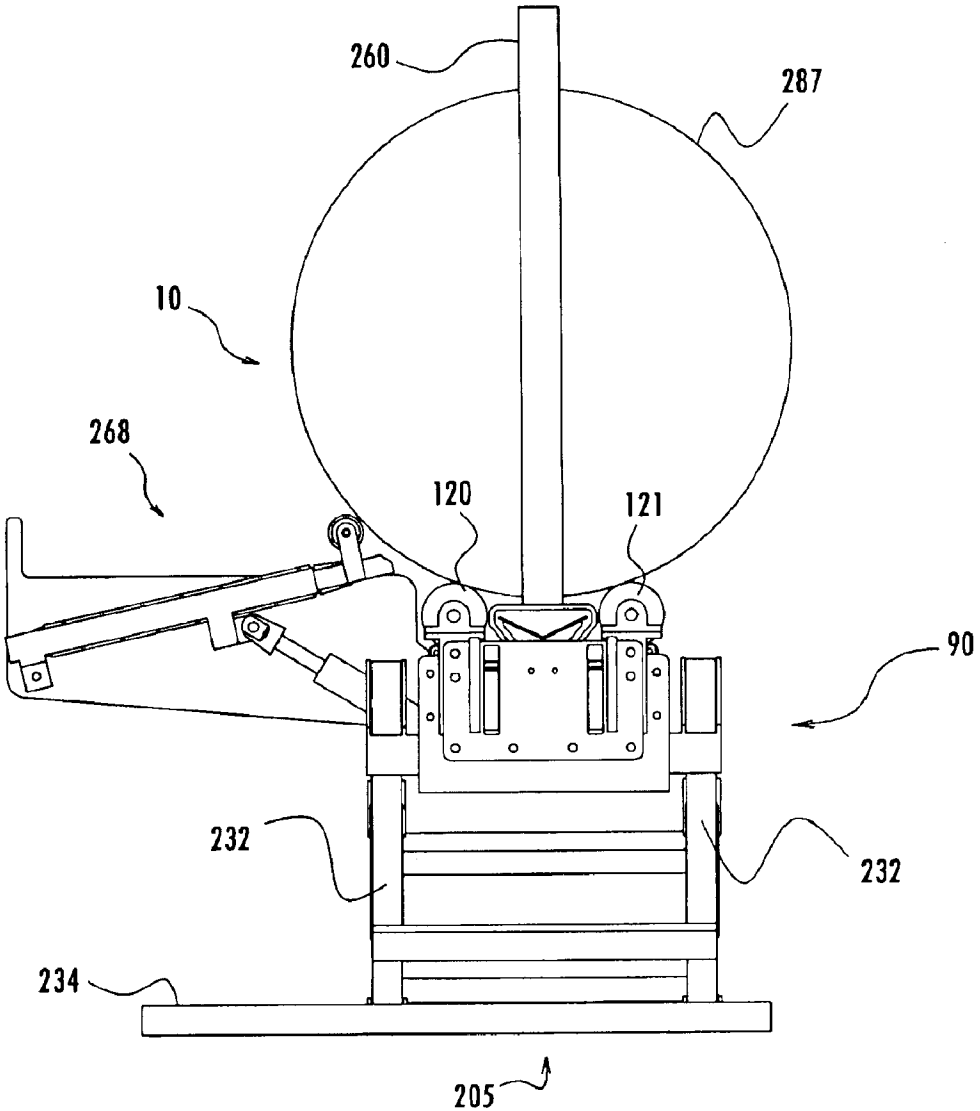
FIG. 45 is an end elevation of the apparatus illustrated in FIG. 35 which shows the loading module in a raised position.

An end view of the apparatus 10 of FIG. 35 that is similar to FIG. 44 is illustrated in FIG. 45. Unlike FIG. 44, FIG. 45 illustrates the case where the frame members 232 have raised the loading module 90.

The height of the loading module 90 is typically varied before the loading of reinforcing rods 44 into the former 40 and before the welding phase of the construction process commences. When the reinforcing rods 44 are being loaded into the former 40, the height of the loading module 90 is adjusted so that the guide rail 129 is aligned with a lowermost tube 43 of the former 40. After the reinforcing rods 44 have been loaded into the former 40 the loading module 90 is lowered so that the outer periphery of the constructed cage will engage with the rollers 120, 121 of the support module 90.

Figure 46:
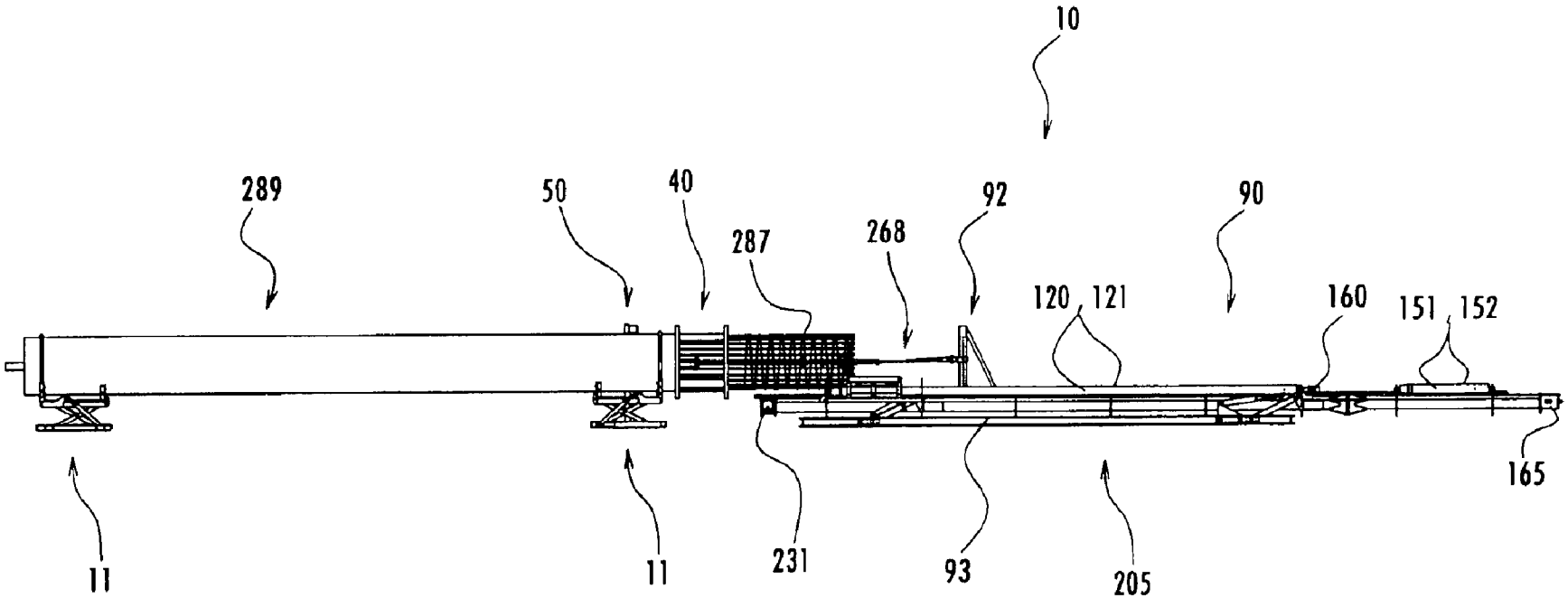
FIG. 46 is a front elevation of an apparatus for making reinforcing cages for concrete piles according to a fourth embodiment of the invention.

A fourth embodiment of the apparatus 10 is illustrated in FIG. 46. For convenience, features of the apparatus 10 that are similar or correspond to features of the previously described embodiments of the apparatus 10 have been referenced using the same reference numbers. The apparatus 10 is configured for constructing reinforcing cages for concrete piles. The apparatus 10 does not have a support assembly 170. Instead, the apparatus 10 utilises a long former 289 which is supported at either end by frames 11. A former 40, similar to that illustrated in FIG. 17 is also attached to the end of the former 289 which is closest to the loading module 90. Additional rollers 151, 152 are also mounted to the loading module 90. A press assembly 50 similar to that previously described is also included.

Figure 47:
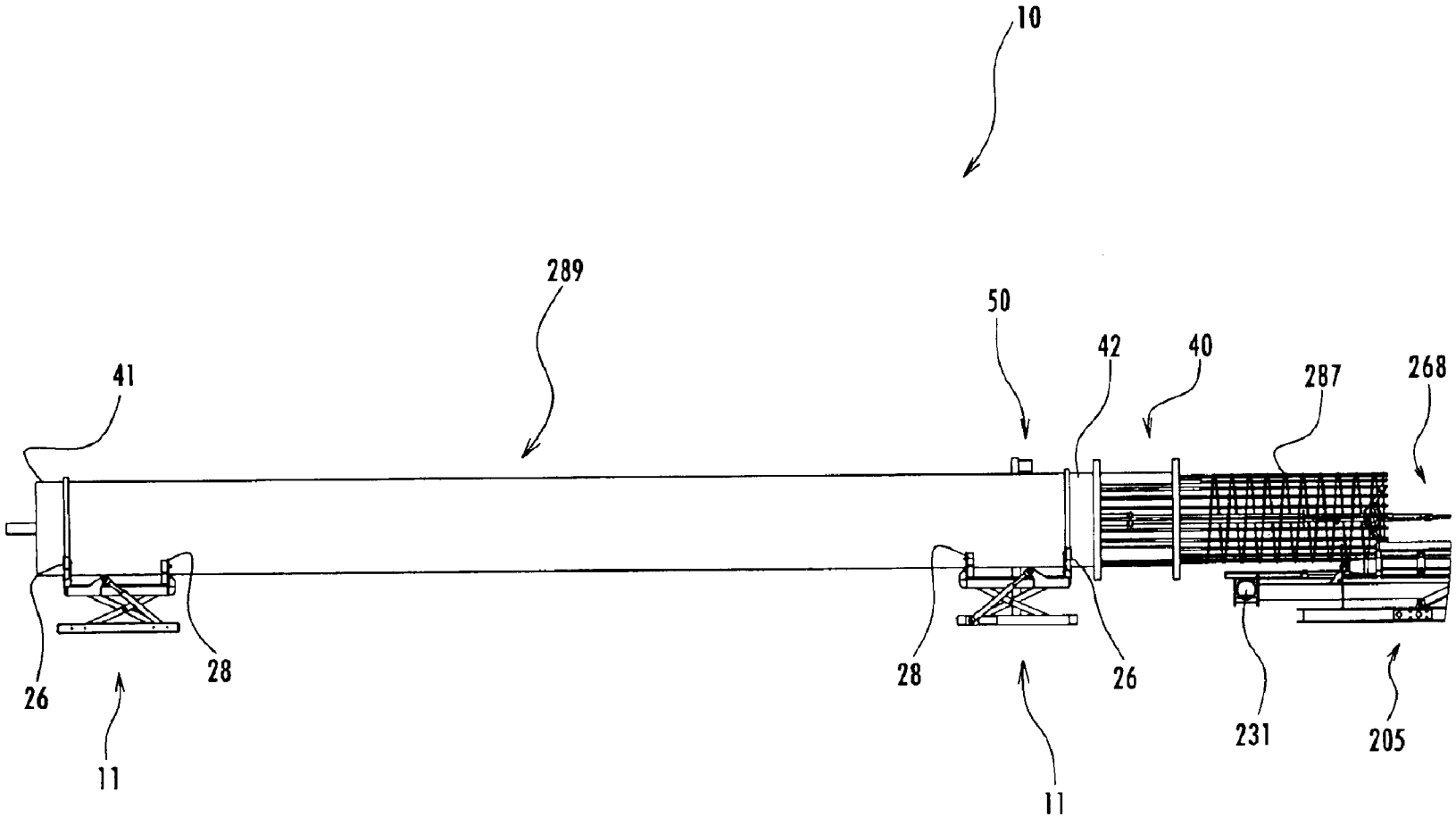
FIG. 47 is a front elevation of a portion of the apparatus illustrated in FIG. 46.

FIG. 47 provides further detail regarding the way in which the former 289 is mounted on the frames 11. It can be seen that rings 41 and 42 engage with rollers 28 and 26 respectively.

Figure 48:
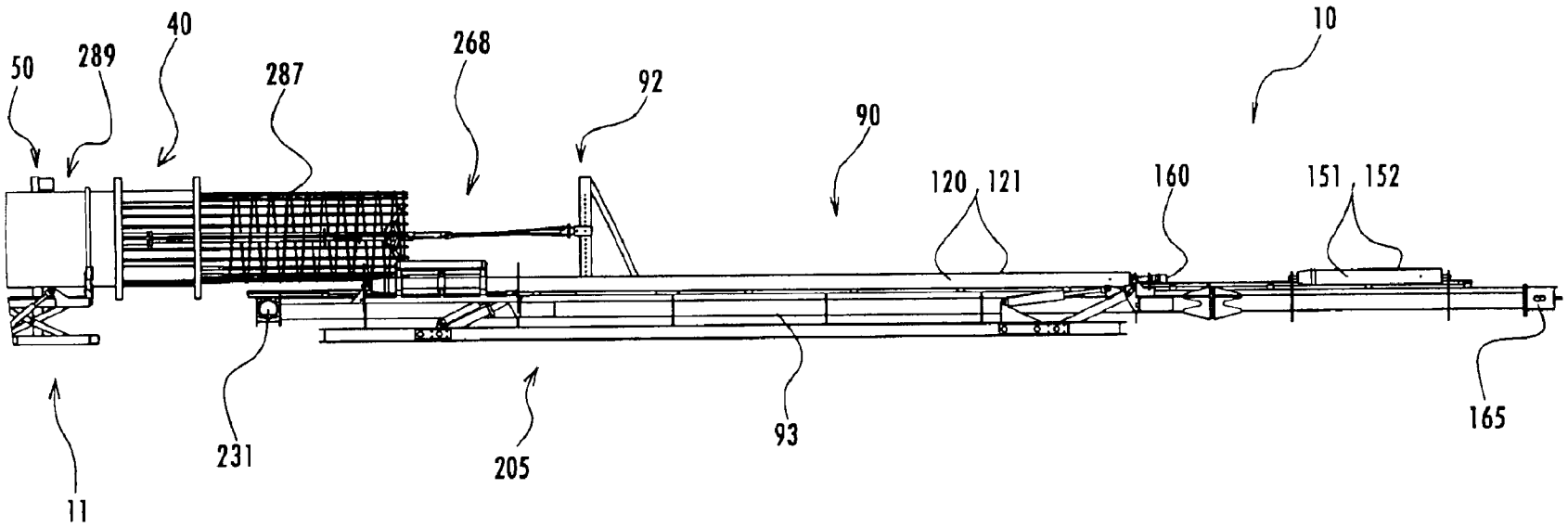
FIG. 48 is a front elevation of a portion of the apparatus illustrated in FIG. 46.

FIG. 48 provides further detail of the loading module 90 portion of the apparatus 10. The additional rollers 151 and 152 are located near the drive 165.

Figure 49:
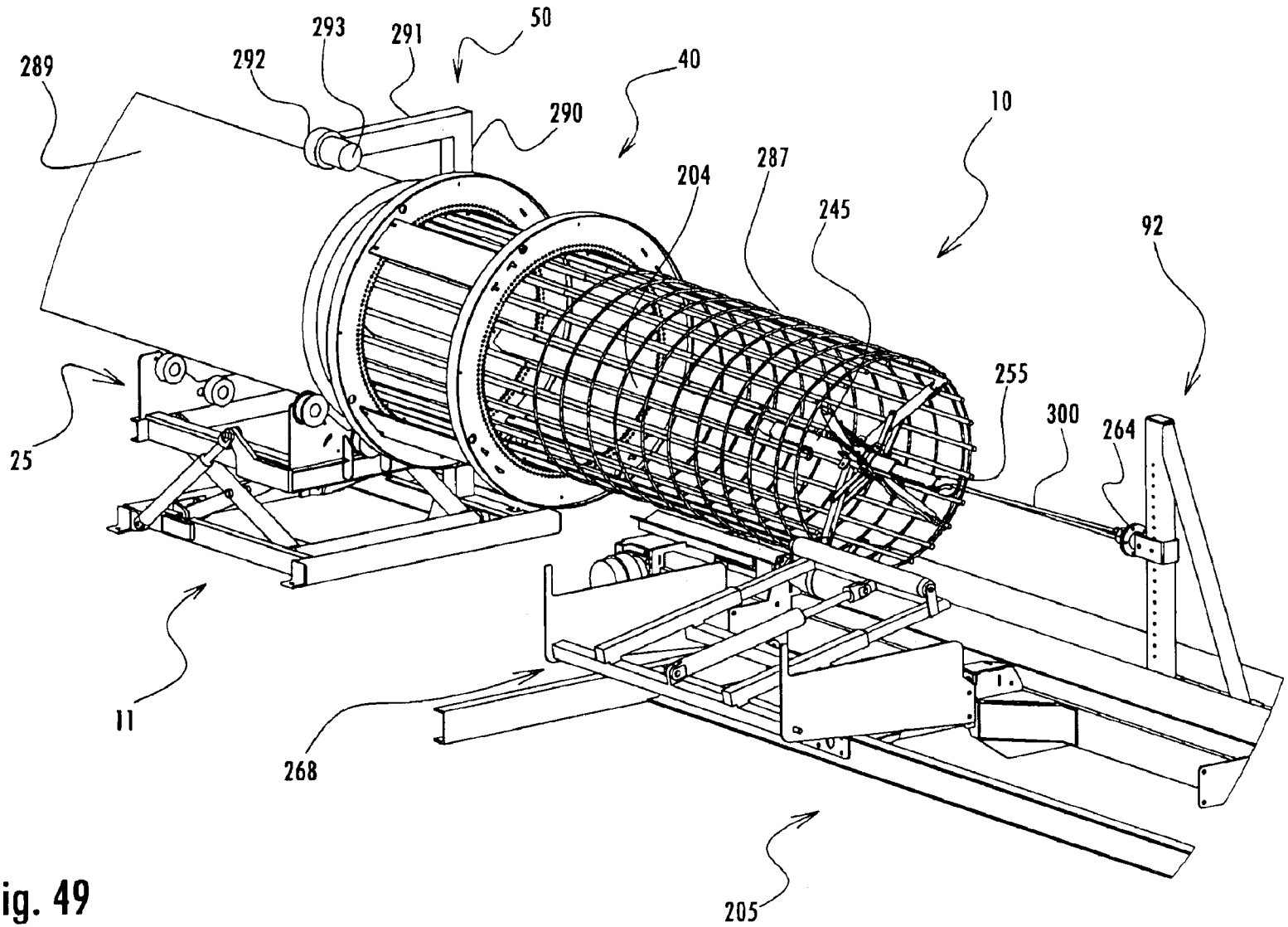
FIG. 49 is a perspective view of a portion of the apparatus illustrated in FIG. 46.

A perspective view of the apparatus 10 of FIG. 46 is shown in FIG. 49. The third axle 204 can be retracted into the former 289. Also, an elastic member 300 connects the hook 255 to the rotatable disc 264. The press assembly 50 includes frame members 290, 291 and a roller 292 which is coupled to a driver 293. The driver 293 is operable to rotate the roller 292. Rotation of the roller 292 causes the former 289 to rotate.

Figure 50:
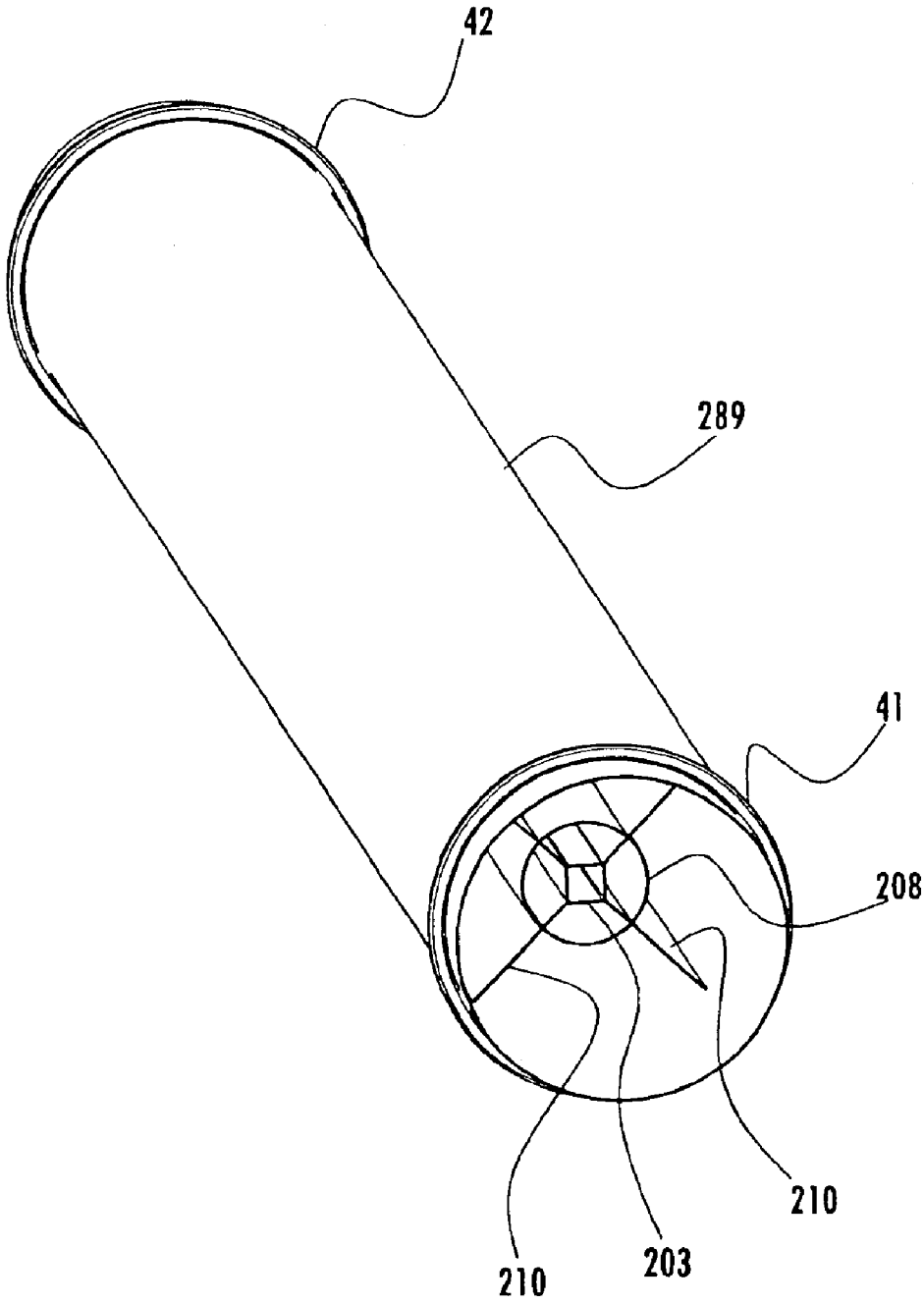
FIG. 50 is a perspective view of the former which forms part of the apparatus illustrated in FIG. 46.

The former 289 is illustrated in greater detail in FIG. 50. The former 289 is similar to the former 40 illustrated in FIG. 13.

Figure 51:
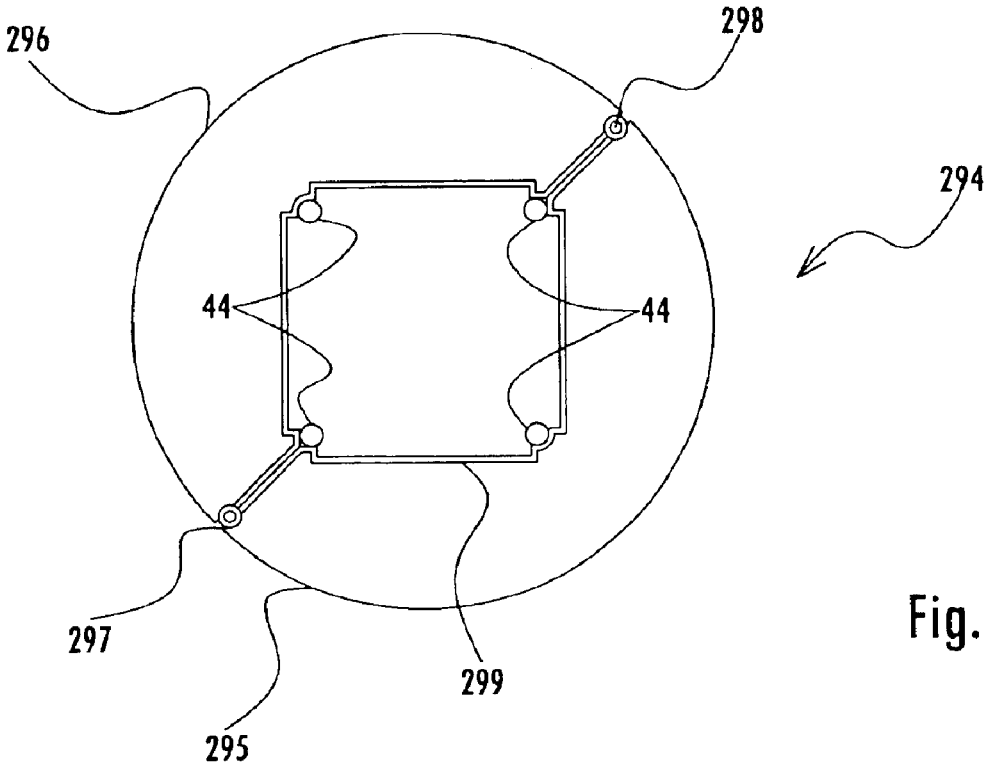
FIG. 51 is an end view of a cage clamp.

FIG. 51 illustrates a clamp 294 which is used for clamping the reinforcing rods 44 of cages having non-circular cross-sections. By attaching the clamp 294 onto the portion of a cage which is located over the loading module 90 during the construction of the cage, the rollers 120, 121 can engage with the clamps 294 and therefore rotate the non-circular cage.

In the embodiment shown, the clamp 294 has two substantially identical halves 295 and 296 which are hinged at 297 and fixed at 298. The clamp 294 has a void which is bordered by edge 299. The clamp 294 is shown clamped around the reinforcing rods 44 of a cage having a square cross-section. It should be appreciated though that the clamp 294 could be modified to accommodate cages with a variety of cross-sections.

Figure 52:
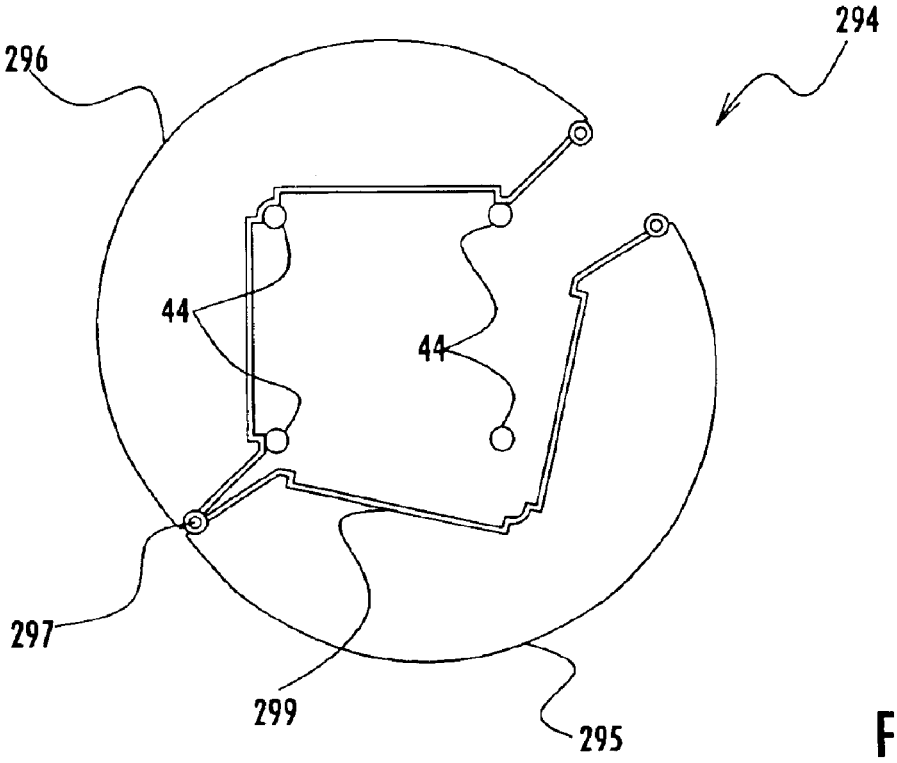
FIG. 52 is an end view of the cage clamp illustrated in FIG. 51 in an open position.

FIG. 52 illustrates how the clamp 294 may be attached/detached to/from a cage.

The foregoing describes only some embodiments of the present invention and modifications, obvious to those skilled in the art, can be made thereto without departing from the scope of the present invention.

It is to be understood that the term "comprising" as used herein is to be understood in the inclusive sense of "having" or "including" and not in the exclusive sense of "consisting essentially of".

What is claimed is:

1. An apparatus for making a reinforcing cage, the apparatus comprising a frame, a former adapted to receive a plurality of longitudinally extending reinforcing rods, a bed supported by the frame, wherein the former rests on and is able to rotate relative to the bed, a drive for rotating the former, a loading module located adjacent to the former, and having a shuttle mounted for longitudinal reciprocal movement towards and away from the former, whereby the shuttle may feed reinforcing rods into the former as it moves towards the former, and may withdraw the reinforcing rods from the former as a reinforcing band is placed around the withdrawn reinforcing rods, and a rotatable cage holder a adapted to hold on to the reinforcing cage and to rotate with the former while holding on to the cage such that the former is unable to rotate relative to the cage holder, whereby the cage holder is able to substantially prevent twisting of the reinforcing rods as the former rotates.

2. The apparatus of claim 1, wherein the frame is adapted to raise and lower the former.

3. The apparatus of claim 1, wherein the former includes a plurality of reinforcing rod supporting members.

4. The apparatus of claim 3, wherein the supporting members include tubes.

5. The apparatus of claim 4, wherein the tubes are circumferentially spaced from one another and are secured together to define a cylindrical former.

6. The apparatus of claim 5, wherein the tubes are secured together by a plurality of longitudinally spaced rings which extend about the tubes.

7. The apparatus of claim 5, wherein the tubes are secured to a cylindrical pipe.

8. The apparatus of claim 7, wherein the tubes extend past at least one end of the pipe.

9. The apparatus of claim 7, wherein the supporting members include at least one plate which is secured to the pipe, the plate having apertures extending therethrough.

10. The apparatus of claim 9, wherein tubes extend from the apertures.

11. The apparatus of claim 4, wherein the tubes are secured together by a plurality of longitudinally spaced rings which extend about the tubes.

12. The apparatus of claim 11, wherein the locations of the tubes relative to each other is adjustable.

13. The apparatus of claim 3, wherein the supporting members include at least one plate having apertures extending therethrough.

14. The apparatus of claim 13, wherein the plate is secured to a cylindrical pipe.

15. The apparatus of claim 13, wherein tubes extend from the apertures.

16. The apparatus of claim 1, wherein the bed includes a plurality of rollers which are adapted to support the former.

17. The apparatus of claim 16, wherein at least one of the rollers is driven by the drive.

18. The apparatus of claim 1, further having a press assembly adapted to bias the former onto the bed.

19. The apparatus of claim 1, wherein the loading module includes a table adjacent the shuttle onto which reinforcing rods may be positioned and presented to allow the shuttle to feed the rods to the former.

20. The apparatus of claim 19, wherein the loading module includes longitudinally extending rails along which the shuttle may be driven for movement towards and away from the former.

21. The apparatus of claim 20, wherein the shuttle includes an upright member having one end receivable by the rails.

22. The apparatus of claim 19, wherein the loading module includes a pair of longitudinally extending support rollers arranged on opposite sides of the shuttle on which the reinforcing cage is rotatably supported as the shuttle moves away from the former.

23. The apparatus of claim 22, wherein the support rollers are driven by a drive.

24. The apparatus of claim 22, wherein a cantilevered support extends from one end of the loading module, the cantilevered support forming an extension to the loading module.

25. The apparatus of claim 19, further having an unloading ramp on one side of the shuttle opposite the table.

26. The apparatus of claim 1, wherein the loading module is adapted to be raised and lowered.

27. The apparatus of claim 1, wherein the loading module includes a drive and at least one drive chain which extends between that drive and the shuttle.

28. The apparatus of claim 1, wherein the rotatable cage holder includes an axle which is coupled to the former such that the axle rotates in unison with the former.

29. The apparatus of claim 28, wherein the rotatable cage holder includes a plurality of cage engaging members which extend from the axle, wherein the cage engaging members are adapted to engage with the reinforcing cage.

30. The apparatus of claim 29, wherein the rotatable cage holder includes a rotatable hub which is mounted to the shuttle, the hub being adapted to couple with the axle.

31. The apparatus of claim 30, further having a drive adapted to be coupled to the axle and to move the axle towards the former.

32. The apparatus of claim 31, wherein the drive includes a winch.

33. The apparatus of claim 28, wherein the rotatable cage holder includes a plurality of cage engaging members which extend from a rotatable hub which is mounted to the shuttle, the cage engaging members being adapted to engage with the reinforcing cage.

34. The apparatus of claim 33, wherein the hub is adapted to couple with the axle.

35. The apparatus of claim 1, further having a feed for feeding a reinforcing bar in a spiral fashion as the cage is made.

36. The apparatus of claim 35, wherein the feed includes guide rollers which are adapted to direct the reinforcing bar in a spiral fashion about the reinforcing rods extending from the former.

37. The apparatus of claim 1, further having a support assembly which is adjacent to the former, the support assembly being adapted to support the reinforcing rods introduced into the former.

38. The apparatus of claim 37, wherein the support assembly is adapted to be raised and lowered.

39. The apparatus of claim 37, wherein the support assembly includes support spiders consisting of frames and support discs rotatably received by the frames.

40. The apparatus of claim 39, wherein the support discs are coupled to the former such that the support discs and the former rotate in unison.

41. The apparatus of claim 40, wherein the support discs are coupled to the former by an axle.

42. The apparatus of claim 41, wherein the support assembly includes a guide adjacent to one of the discs, the guide being adapted to direct ends of the rods which project through the former into supporting engagement with the disc.

43. The apparatus of claim 1, further having an ejection module which is operable to eject a reinforcing cage from the loading module.

44. The apparatus of claim 43, wherein the ejection module is adapted to support a reinforcing cage.

45. The apparatus of claim 1, further having a support module which is adapted to support a reinforcing cage.

* * * * *